US011197084B2

(12) United States Patent
Li et al.

(10) Patent No.: US 11,197,084 B2
(45) Date of Patent: Dec. 7, 2021

(54) LOUDSPEAKER APPARATUS

(71) Applicant: SHENZHEN VOXTECH CO., LTD., Guangdong (CN)

(72) Inventors: Chaowu Li, Shenzhen (CN); Yongjian Li, Shenzhen (CN)

(73) Assignee: SHENZHEN VOXTECH CO., LTD., Shenzhen (CN)

( * ) Notice: Subject to any disclaimer, the term of this patent is extended or adjusted under 35 U.S.C. 154(b) by 0 days.

(21) Appl. No.: 17/137,389

(22) Filed: Dec. 30, 2020

(65) Prior Publication Data

US 2021/0120327 A1 Apr. 22, 2021

Related U.S. Application Data

(63) Continuation of application No. PCT/CN2019/102397, filed on Aug. 24, 2019.

(30) Foreign Application Priority Data

Jan. 5, 2019 (CN) ..... 201910009927.4

(51) Int. Cl.
*H04R 1/10* (2006.01)
*H04R 1/02* (2006.01)
(Continued)

(52) U.S. Cl.
CPC ..... *H04R 1/105* (2013.01); *H04R 1/023* (2013.01); *H04R 1/026* (2013.01); *H04R 1/1008* (2013.01);
(Continued)

(58) Field of Classification Search
CPC ..... H04R 1/1066; H04R 1/105; H04R 9/02; H04R 9/06
See application file for complete search history.

(56) References Cited

U.S. PATENT DOCUMENTS 10,306,351 B2 * 5/2019 Kim ..... H04R 1/1066
2013/0163791 A1 6/2013 Qi et al.
(Continued)

FOREIGN PATENT DOCUMENTS

CN 203827497 U 9/2014
CN 204465795 U 7/2015
(Continued)

OTHER PUBLICATIONS

International Search Report in PCT/CN2019/102397 dated Oct. 29, 2019, 6 pages.
(Continued)

*Primary Examiner* — Amir H Etesam
(74) *Attorney, Agent, or Firm* — Metis IP LLC

(57) ABSTRACT

The present disclosure discloses a loudspeaker apparatus. The loudspeaker apparatus may include an ear hook, a core housing, and a circuit housing. The ear hook may include a first plug end and a second plug end. The ear hook may be surrounded by a protective sleeve. The protective sleeve may be made of an elastic waterproof material. The core housing may be used for accommodating an earphone core. The core housing may be fixed to the first plug end and elastically abutted against the protective sleeve. The circuit housing may be used for accommodating a control circuit or a battery. The circuit housing may be fixed to the second plug end. The control circuit or the battery may drive the earphone core to vibrate. The vibration of the earphone core may generate a driving force to drive a housing panel of the core housing to vibrate. The driving force may be not parallel to a normal line of the housing panel. In the present disclosure, the core housing may elastically abut against the protective sleeve surrounding the ear hook to improve the overall waterproof effect of the loudspeaker apparatus and
(Continued)

simplify the manufacturing and assemble process of the loudspeaker apparatus.

20 Claims, 14 Drawing Sheets

(51) Int. Cl.
*H04R 31/00* (2006.01)
*H04R 9/02* (2006.01)

(52) U.S. Cl.
CPC ..... *H04R 1/1041* (2013.01); *H04R 1/1058* (2013.01); *H04R 1/1091* (2013.01); *H04R 9/025* (2013.01); *H04R 31/00* (2013.01); *H04R 1/1016* (2013.01); *H04R 1/1025* (2013.01); *H04R 2201/10* (2013.01); *H04R 2460/13* (2013.01)

(56) References Cited

U.S. PATENT DOCUMENTS

| | | | |
|---|---|---|---|
| 2016/0329041 | A1 | 11/2016 | Qi et al. |
| 2017/0318369 | A1 | 11/2017 | Wang |
| 2020/0336824 | A1 | 10/2020 | Zheng et al. |

FOREIGN PATENT DOCUMENTS

| | | | |
|---|---|---|---|
| CN | 107484054 | A | 12/2017 |
| CN | 207010974 | U | 2/2018 |
| CN | 207039848 | U | 2/2018 |
| CN | 207039849 | U | 2/2018 |
| CN | 207039851 | U | 2/2018 |
| CN | 207070282 | U | 3/2018 |
| CN | 207783068 | U | 8/2018 |
| CN | 109547905 | A | 3/2019 |
| CN | 109660901 | A | 4/2019 |
| CN | 109714687 | A | 5/2019 |
| CN | 109769167 | A | 5/2019 |
| CN | 109788386 | A | 5/2019 |
| CN | 209089198 | U | 7/2019 |
| CN | 209184800 | U | 7/2019 |
| CN | 209184801 | U | 7/2019 |
| CN | 209267804 | U | 8/2019 |
| CN | 209358729 | U | 9/2019 |
| WO | 2018175192 | A1 | 9/2018 |

OTHER PUBLICATIONS

International Search Report in PCT/CN2019/102399 dated Oct. 30, 2019, 7 pages.
International Search Report in PCT/CN2019/102392 dated Nov. 21, 2019, 7 pages.
International Search Report in PCT/CN2019/102400 dated Nov. 22, 2019, 8 pages.
International Search Report in PCT/CN2019/102393 dated Nov. 25, 2019, 7 pages.

* cited by examiner

LOUDSPEAKER APPARATUS

CROSS REFERENCE TO RELATED APPLICATIONS

This application is a Continuation of International Application No. PCT/CN2019/102397 filed on Aug. 24, 2019, which claims priority of Chinese Patent Application No. 201910009927.4, filed on Jan. 5, 2019, the entire contents of which are incorporated herein by reference.

TECHNICAL FIELD

The present disclosure relates to a loudspeaker apparatus, and in particular, to a loudspeaker apparatus with a waterproof function.

BACKGROUND

Generally, people can hear the sound because air transmits vibration to the eardrum through the external ear canal, and the vibration formed by the eardrum drives the human auditory nerve, thereby perceiving the sound. At present, earphones are widely used in people's lives. For example, users can use earphones to play music, answer calls, etc. Earphones have become an important item in people's daily life. Ordinary earphones can no longer meet the normal use of users in some special scenes (e.g., swimming, rainy days, etc.). Thus, earphones with waterproof function and better sound quality are more popular with consumers. Therefore, it may be necessary to provide a loudspeaker apparatus with waterproof function and easy to produce and assemble.

SUMMARY

The embodiments of the present disclosure provide a loudspeaker apparatus. The loudspeaker apparatus may include an ear hook, a core housing, and a circuit housing. The ear hook may include a first plug end and a second plug end. The ear hook may be surrounded by a protective sleeve. The protective sleeve may be made of an elastic waterproof material. The core housing may be used for accommodating an earphone core. The core housing may be fixed to the first plug end and elastically abutted against the protective sleeve. The circuit housing may be used for accommodating a control circuit or a battery. The circuit housing may be fixed to the second plug end. The control circuit or the battery may drive the earphone core to vibrate. The vibration of the earphone core may generate a driving force to drive a housing panel of the core housing to vibrate. The driving force may be not parallel to a normal line of the housing panel.

In some embodiments, the ear hook may further include an elastic metal wire, a wire, and a fixed sleeve. The fixed sleeve may fix the wire on the elastic metal wire. The protective sleeve may be formed, by injection molding, on periphery of the elastic metal wire, the wire, the fixed sleeve, the first plug end, and the second plug end.

In some embodiments, the first plug end and the second plug end may be formed, by injection molding, at both ends of the elastic metal wire respectively. The first plug end and the second plug end may be arranged with a first wiring channel and a second wiring channel respectively. The wire may extend along the first wiring channel and the second wiring channel.

In some embodiments, the wire may pass through the first wiring channel and the second wiring channel.

In some embodiments, the first wiring channel may include a first wiring groove and a first wiring hole connecting the first wiring groove and an outer end surface of the first plug end. The wire may extend along the first wiring groove and the first wiring hole and be exposed on the outer end surface of the first plug end. The second wiring channel may include a second wiring groove and a second wiring hole connecting the second wiring groove and the outer end surface of the first plug end. The wire may extend along the second wiring groove and the second wiring hole and be exposed on the outer end surface of the second plug end.

In some embodiments, the ear hook may include at least two fixed sleeves spaced apart along the elastic metal wire.

In some embodiments, the core housing may be arranged with a first socket connecting with an outer end surface of the core housing. A stopping block may be arranged on an inner sidewall of the first socket. The first socket may be connected to the first plug end.

In some embodiments, the first plug end may include an inserting portion and two elastic hooks.

In some embodiments, the inserting portion may be at least partially inserted into the first socket and abut against an outer side surface of the stopping block. The two elastic hooks may be arranged on a side of the inserting portion facing inside of the core housing. The two elastic hooks may be brought together under action of external thrust and the stopping block. After passing through the stopping block, the two elastic hooks may be elastically restored to be stuck on an inner surface of the stopping block to realize the fixation of the core housing and the first plug end.

In some embodiments, the inserting portion may be partially inserted into the first socket. An exposed part of the inserting portion may be arranged in a stepped manner to form an annular table surface spaced apart from the outer end surface of the core housing.

In some embodiments, the protective sleeve may further extend to a side of the annular table surface facing the outer end surface of the core housing. When the core housing and the first plug end are fixed, the protective sleeve may elastically abut against the core housing to realize sealing.

In some embodiments, the loudspeaker apparatus may further include a fastener. The circuit housing may be arranged with a second socket and the second plug end may be at least partially inserted into the second socket and connected to the second socket by the fastener.

In some embodiments, the second plug end may be arranged with a slot perpendicular to an inserting direction of the second socket. A through hole corresponding to a position of the slot may be arranged on a first sidewall of the circuit housing. The fastener may include two parallel pins and a connecting portion for connecting the pins. The pins may be inserted into the slot from outside of the circuit housing through the through hole to realize the plug and fixation of the circuit housing and the second plug end.

In some embodiments, the ear hook may further include a housing sheath integrally formed with the protective sleeve. The housing sheath may be wrapped around periphery of the circuit housing.

In some embodiments, the housing panel and the earphone core may be in a transmission connection. All or part of the housing panel may be used to contact or abut a user's body to conduct a sound generated by the vibration of the earphone core.

In some embodiments, when a straight line of the driving force has a positive direction pointing to outside of the loudspeaker apparatus from the housing panel and the normal line has a positive direction pointing to the outside of the loudspeaker apparatus, an angle between the two lines in their positive direction may be an acute angle.

In some embodiments, the earphone core may include a coil and a magnetic circuit system. An axis of the coil or the magnetic circuit system may be not parallel to the normal line. The axis may be perpendicular to a radial plane of the coil or the magnetic circuit system.

In some embodiments, the driving force may have a component in a first quadrant or a third quadrant of an XOY plane coordinate system. An origin O of the XOY plane coordinate system may be on a contact surface between the loudspeaker apparatus and a human body. An X-axis of the XOY plane coordinate system may be parallel to a coronal axis of the human body. A Y-axis of the XOY plane coordinate system may be parallel to a sagittal axis of the human body. A positive direction of the X-axis may face outside of the human body. A positive direction of the Y-axis may face front of the human body.

In some embodiments, a region of the housing panel used to contact or abut the user's body may include a flat surface or a quasi-flat surface.

In some embodiments, the earphone core may further include a magnetic circuit component generating a first magnetic field. The magnetic circuit component may include a first magnetic unit configured to generate a second magnetic field, a first magnetically conductive unit, and at least one second magnetic unit. The at least one second magnetic unit may surround the first magnetic unit and form a magnetic gap with the first magnetic unit. A magnetic field strength of the first magnetic field in the magnetic gap may be greater than a magnetic field strength of the second magnetic field in the magnetic gap.

In some embodiments, the magnetic circuit component may further include a second magnetically conductive unit and at least one third magnetic unit being connected to the second magnetically conductive unit and the at least one second magnetic unit.

In some embodiments, the magnetic circuit component may further include at least one fourth magnetic unit being located below the magnetic gap and connected to the first magnetic unit and the second magnetically conductive unit.

In some embodiments, the magnetic circuit component may further include at least one fifth magnetic unit being connected to an upper surface of the first magnetically conductive unit.

In some embodiments, the magnetic circuit component may further include a third magnetically conductive unit being connected to an upper surface of the fifth magnetic unit. The third magnetically conductive unit may be configured to suppress a leakage of a field strength of the first magnetic field.

In some embodiments, the first magnetically conductive unit may be connected to the upper surface of the first magnetic unit. The second magnetically conductive unit may include a bottom plate and a sidewall. The first magnetic unit may be connected to the bottom plate of the second magnetically conductive unit.

In some embodiments, the magnetic circuit component may further include at least one electrically conductive unit connected to the first magnetic unit, the first magnetically conductive unit, and/or the second magnetically conductive unit.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures, and wherein.

DETAILED DESCRIPTION

Figure 1:
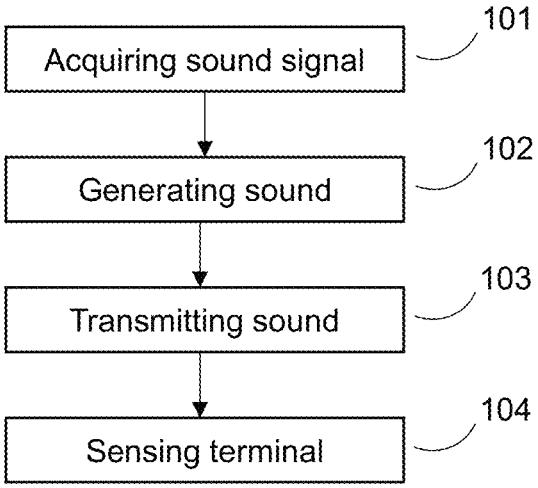
FIG. 1 is a flowchart illustrating an exemplary process for generating auditory sense through a loudspeaker apparatus according to some embodiments of the present disclosure.

In the following detailed description, numerous specific details are set forth by way of examples in order to provide a thorough understanding of the relevant disclosure. Obviously, drawings described below are only some examples or embodiments of the present disclosure. Those skilled in the art, without further creative efforts, may apply the present disclosure to other similar scenarios according to these drawings. It should be understood that the purposes of these illustrated embodiments are only provided to those skilled in the art to practice the application, and not intended to limit the scope of the present disclosure. Unless obviously obtained from the context or the context illustrates otherwise, the same numeral in the drawings refers to the same structure or operation.

As used in the disclosure and the appended claims, the singular forms "a," "an," and "the" may include plural referents unless the content clearly dictates otherwise. In general, the terms "comprise" and "include" merely prompt to include steps and elements that have been clearly identified, and these steps and elements do not constitute an exclusive listing. The methods or devices may also include other steps or elements. The term "based on" is "based at least in part on." The term "one embodiment" means "at least one embodiment;" the term "another embodiment" means "at least one other embodiment." Related definitions of other terms will be given in the description below. In the following, without loss of generality, the description of "player", "loud speaking component", "loudspeaker device" or "loudspeaker component" may be used when describing a related technology of sound conduction in the present disclosure. This description is only a form of sound conduction application. For those skilled in the art, "player", "playing device", "loud speaking component", "loudspeaker device" or "hearing aid" may also be replaced with other similar words. In fact, various implementations in the present disclosure may be easily applied to other non-speaker component hearing devices. For example, for those skilled in the art, after understanding the basic principle of the loud speaking component, it may be possible to make various modifications and changes in the form and details of the specific methods and operations of implementing the loud speaking component without departing from the principles. In particular, an environmental sound collection and processing function may be added to the loud speaking component to implement the function of a hearing aid. For example, in the case of using a bone conduction loud speaking component, adding a microphone that may pick up the sound of a user/wearer's surrounding environment, processing the sound using a certain algorithm and transmit the processed sound (or generated electrical signal) to a loud speaking component of eyeglasses. That is, the bone conduction loud speaking component may be modified to include the function of collecting the environmental sound, and after a certain signal processing, the sound may be transmitted to the user/wearer via the bone conduction loud speaking component, thereby implementing the function of the bone conductive hearing aid. As an example, the algorithm mentioned herein may include noise cancellation, automatic gain control, acoustic feedback suppression, wide dynamic range compression, active environment recognition, active noise reduction, directional processing, tinnitus processing, multi-channel wide dynamic range compression, active howling suppression, volume control, or the like, or any combination thereof.

FIG. 1 is a flowchart illustrating an exemplary process for generating auditory sense through a loudspeaker apparatus according to some embodiments of the present disclosure. The loudspeaker apparatus may transfer sound to an auditory system through bone conduction or air conduction by a built-in loudspeaker, thereby generating an auditory sense. As shown in FIG. 1, the process for generating the auditory sense through the loudspeaker apparatus may include operations 101-104.

In 101, the loudspeaker apparatus may acquire or generate a signal (also referred to as a "sound signal") containing sound information. In some embodiments, the sound information may refer to a video file or an audio file with a specific data format. The sound information may refer to data or files that may be converted to be sound through specific approaches. In some embodiments, the signal containing the sound information may be obtained from a storage unit of a loudspeaker apparatus itself. In some embodiments, the signal containing the sound information may be obtained from an information generation system, a storage system, or a delivery system other than the loudspeaker apparatus. The signal containing the sound information may be not limited to an electrical signal, and may also include other forms of signals other than the electrical signal, such as an optical signal, a magnetic signal, and a mechanical signal, or the like. In principle, as long as the signal includes information that may be used to generate sounds by loudspeaker apparatus, the signal may be processed as the sound signal. In some embodiments, the sound signal may not be limited to one signal source, and it may come from a plurality of signal sources. The plurality of signal sources may be independent of or dependent on each other. In some embodiments, manners of generating or transmitting the sound signal may be wired or wireless and may be real-time or time-delayed. For example, the loudspeaker apparatus may receive an electrical signal containing sound information via a wired or wireless connection or may obtain data directly from a storage medium and generate a sound signal. Taking bone conduction technology as an example, components with sound collection function may be added to a bone conductive loudspeaker. The bone conductive loudspeaker may pick up sound from ambient environment and convert mechanical vibration of the sound into an electrical signal. Further, the electrical signal may be processed through an amplifier to meet special requirements. The wired connection may be realized by using including but not limited to metal cables, optical cables, or hybrid cables of metal and optical, such as coaxial cables, communication cables, flexible cables, spiral cables, non-metal sheathed cables, metal sheathed cables, multi-core cables, twisted pair cables, ribbon cables, shielded cables, telecommunications cables, double-stranded cables, parallel twin-core wires, and twisted pairs. Examples described above are only used for illustration purposes. The wired connection may also be realized by using other types of transmission carriers, such as transmission carriers for electrical or optical signal.

The storage device or storage unit mentioned herein may include a direct attached storage, a network attached storage, a storage area network, and other storage systems. The storage device may include but is not limited to common types of storage devices such as a solid-state storage device (a solid-state drive, a solid-state hybrid hard drive, etc.), a mechanical hard drive, a USB flash drive, a memory stick, a storage card (e.g., CF, SD, etc.), and other drives (e.g., CD, DVD, HD DVD, Blu-ray, etc.), a random access memory (RAM), a read-only memory (ROM), etc. The RAM may include but is not limited to a decimal counter, a selection tube, a delay line memory, a Williams tube, a dynamic random access memory (DRAM), a static random access memory (SRAM), a thyristor random access memory (T-RAM), a zero capacitive random access memory (Z-RAM), etc. The ROM may include but is not limited to a magnetic bubble memory, a magnetic button line memory, a thin film memory, a magnetic plating line memory, a magnetic core memory, a drum memory, an optical disk driver, a hard disk, a magnetic tape, an early non-volatile memory (NVRAM), a phase change memory, a magneto-resistive random access memory, a ferroelectric random access memory, a non-volatile SRAM, a flash memory, an electronically erasable rewritable read-only memory, an erasable programmable read-only memory, a programmable read-only memory, a shielded heap read memory, a floating connection gate random access memory, a nano random access memory, a racetrack memory, a variable resistance memory, a programmable metallization unit, etc. The storage device/storage unit mentioned above are only used for illustration purposes. The storage medium used in the storage device/storage is not limited.

In 102, the loudspeaker apparatus may convert the signal containing sound information into vibrations to generate a sound. The loudspeaker apparatus may use a specific transducer to convert the signal into mechanical vibrations accompanying with energy conversion. The conversion process may include multiple types of energy coexistence and conversion. For example, the electrical signal may be directly converted into mechanical vibrations by the transducers to generate a sound. As another example, the sound information may be included in an optical signal, which may be converted into mechanical vibrations by a specific transducer. Other types of energy that may be coexisted and converted when the transducer works may include thermal energy, magnetic field energy, or the like. In some embodiments, an energy conversion manner of the transducer may include but is not limited to, a moving coil type, an electrostatic type, a piezoelectric type, a moving iron type, a pneumatic type, an electromagnetic type, or the like. A frequency response range and sound quality of the loudspeaker apparatus may be affected by the energy conversion manner and a property of each physical component of the transducer. For example, in a transducer with the moving coil type, a wound cylindrical coil is connected to a vibration plate, the coil driven by a signal current drives the vibration plate to vibrate in the magnetic field, and generate a sound. Factors, such as material expansion and contraction, folds deformation, size, shape, and fixed manner of the vibration plate, the magnetic density of the permanent magnet, etc., may have a large impact on the sound quality of the loudspeaker apparatus.

The term "sound quality" used herein may indicate the quality of sound, which refers to an audio fidelity after post-processing, transmission, or the like. In an audio device, the sound quality may include audio intensity and magnitude, audio frequency, audio overtone, or harmonic components, or the like. When the sound quality is evaluated, measuring manner and the evaluation criteria for objectively evaluating the sound quality may be used, other manners that combine different elements of sound and subjective feelings for evaluating various properties of the sound quality may also be used. Thus, the sound quality may be affected during the processes of generating the sound, transmitting the sound, and receiving the sound.

In 103, the sound is delivered by a delivery system. In some embodiments, the delivery system refers to a substance that can deliver vibration signals containing sound information, such as the skull, bony labyrinth, inner ear lymph, and spiral organs of humans or/and animals with auditory systems. As another example, the delivery system also refers to a medium that may transmit sound (e.g., air and liquid). To illustrate the process of transmitting sound information by the delivery system, a bone conductive loudspeaker may be taken as an example. The bone conductive loudspeaker may directly transmit sound waves (vibration signals) converted from electrical signals to an auditory center through bones. In addition, the sound waves may be transmitted to the auditory center through air conduction. For the content of air conduction, please refer to the description elsewhere in the specification.

In 104, the sound information is transferred to a sensing terminal. Specifically, the sound information is transmitted to the sensing terminal through the delivery system. In a working scenario, the loudspeaker apparatus picks up or generates a signal containing sound information, converts the sound information into a sound vibration by the transducer. The loudspeaker apparatus transmits the sound to the sensing terminal through the delivery system, and finally a user can hear the sound. Generally, the subject of the sensing terminal, the auditory system, the sensory organ, etc. described above may be a human or an animal with an auditory system. It should be noted that the following description of the loudspeaker apparatus used by a human does not constitute a restriction on the use scene of the loudspeaker apparatus, and similar descriptions may also be applied to other animals.

The above description of the process of the loudspeaker apparatus is only a specific example and should not be regarded as the only feasible implementation. Obviously, for persons having ordinary skills in the art, after understanding the basic principle of the loudspeaker apparatus, various modifications and changes may be made in the form and details to the specific ways and steps of implementing the loudspeaker apparatus without departing from the principle. However, those modifications and changes are still within the scope of the present disclosure. For example, between acquiring a signal containing sound information in operation 101 and generating sound in operation 102, a signal correction or enhancement step may be additionally added, which may enhance or modify the signal acquired in operation 101 according to a specific algorithm or parameter. Furthermore, between generating sound in operation 102 and transmitting sound in operation 103, an enhancement or a correction step of the vibration may be additionally added.

Figure 2:
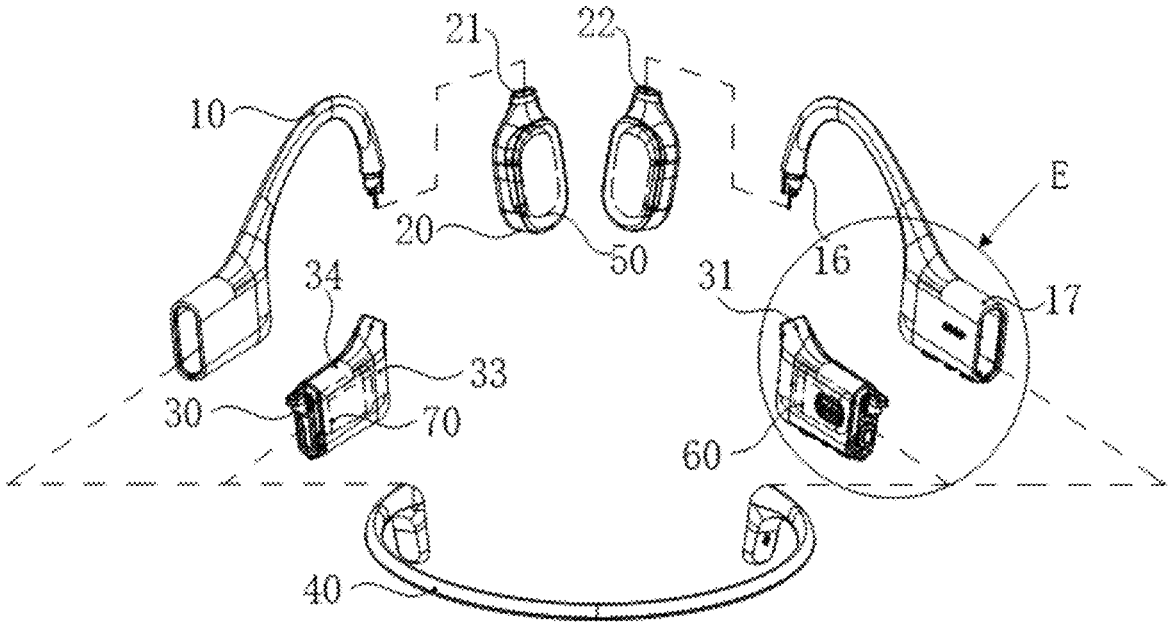
FIG. 2 is an exploded structural diagram of an MP3 player according to some embodiments of the present disclosure.
Figure 3:
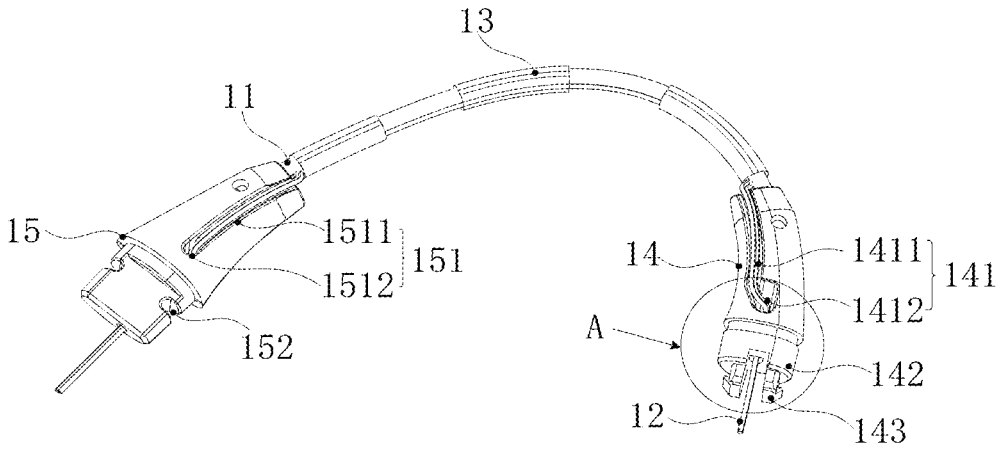
FIG. 3 is a partial structural diagram of an ear hook of an MP3 player according to some embodiments of the present disclosure.
Figure 4:
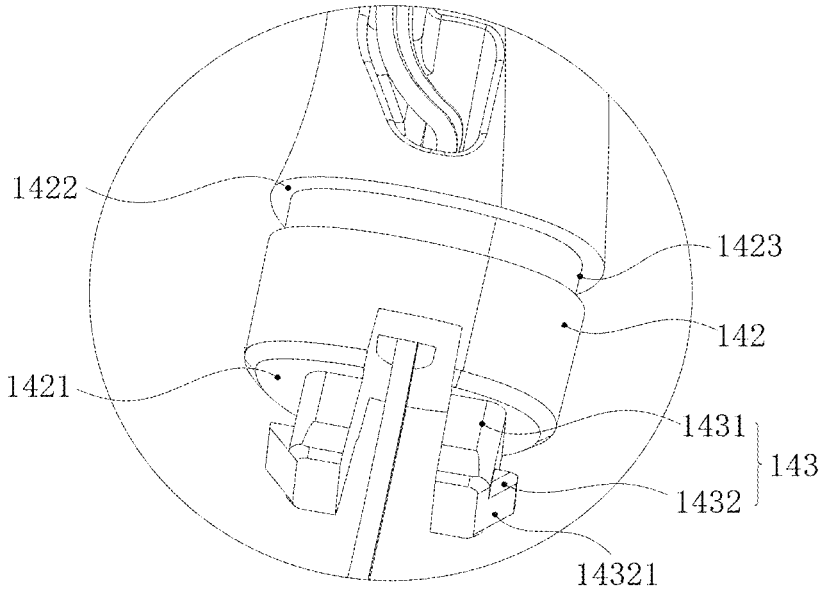
FIG. 4 is a partial enlarged view of part A in FIG. 3.

The loudspeaker apparatus in the specification of the present disclosure may include, but is not limited to, an earphone, an MP3 player, and a hearing aid. In the following specific embodiments of the present disclosure, an MP3 player is taken as an example to describe the loudspeaker apparatus in detail. FIG. 2 is an exploded structural diagram of an MP3 player according to some embodiments of the present disclosure. FIG. 3 is a partial structural diagram of an ear hook in an MP3 player according to some embodiments of the present disclosure. FIG. 4 is an enlarged view of part A in FIG. 3. As shown in FIG. 1, in some embodiments, an MP3 player may include an ear hook 10, a core housing 20, a circuit housing 30, a rear hook 40, an earphone core 50, a control circuit 60, and a battery 70. The core housing 20 and the circuit housing 30 are arranged at two ends of the ear hook 10 respectively, and the rear hook 40 is further arranged at an end of the circuit housing 30 away from the ear hook 10. The number of the core housings 20 is two, which are used to accommodate two earphone cores 50 respectively. The number of the circuit housings 30 is also two, which are used to accommodate the control circuit 60 and the battery 70 respectively. The two ends of the rear hook 40 are connected to the corresponding circuit housings 30 respectively. The ear hook 10 refers to a structure surrounding and supporting a user's ear when the user wears a bone conductive MP3 player, and then suspending and fixing the core housing 20 and the earphone core 50 at a predetermined position of the user's ear.

Combining FIG. 2, FIG. 3, and FIG. 4, in some embodiments, the ear hook 10 may include an elastic metal wire 11, a wire 12, a fixed sleeve 13, a plug end 14, and a plug end 15. The plug end 14 and the plug end 15 may be arranged at both ends of the elastic metal wire 11. In some embodiments, the ear hook 10 may further include a protective sleeve 16 and a housing sheath 17 integrally formed with the protective sleeve 16. The elastic metal wire 11 is mainly used to keep the ear hook 10 in a shape that matches the user's ear. The elastic metal wire 11 has a certain elasticity, so as to generate a certain elastic deformation according to the user's ear shape and head shape to adapt to users with different ear shapes and head shapes. In some embodiments, the elastic metal wire 11 may be made of a memory alloy, which has good deformation recovery ability. Thus, even if the ear hook 10 is deformed by an external force, it may still be restored to its original shape when the external force is removed, and continue to be used by users, thereby extending the life of the MP3 player. In other embodiments, the elastic metal wire 11 may also be made of a non-memory alloy. The wire 12 may be used for electrical connection with the earphone core 50, the control circuit 60, the battery 70, etc. for power supply and data transmission for the operation of the earphone core 50.

The fixed sleeve 13 may be used to fix the wire 12 on the elastic metal wire 11. In this embodiment, there are at least two fixed sleeves 13. The at least two fixed sleeves 13 may be spaced apart along the elastic metal wire 11 and the wire 12, and arranged on the outer periphery of the wire 12 and the elastic metal wire 11 by wrapping to fix the wire 12 on the elastic metal wire 11.

In some embodiments, the plug end 14 and the plug end 15 may be made of hard materials, such as plastic. In some embodiments, the plug end 14 and the plug end 15 may be formed respectively on both ends of the elastic metal wire 11 by injection molding. In some embodiments, the plug end 14 and the plug end 15 may be formed by injection molding separately. Connection holes to connect with the end of the elastic metal wire 11 are respectively reserved during the injection molding of the plug end 14 and the plug end 15. After the injection molding is completed, the plug end 14 and the plug end 15 may be inserted into the corresponding ends of the elastic metal wire 11 respectively by the connection holes or fixed by bonding.

It should be noted that, in this embodiment, the plug end 14 and the plug end 15 may not be directly formed by injection molding on the periphery of the wire 12, which avoids the wire 12 during injection molding. Specifically, when the plug end 14 and the plug end 15 are injection molded, the wire 12 located at both ends of the elastic metal wire 11 may be fixed to be far away from the position of the plug end 14 and the plug end 15. Further, a first wiring channel 141 and a second wiring channel 151 may be arranged respectively on the plug 14 and the plug end 15 to extend the wire 12 along the first wiring channel 141 and the second wiring channel 151 after the injection molding. Specifically, the wire 12 may be threaded into the first wiring channel 141 and the second wiring channel 151 in a threading way after the first wiring channel 141 and the second wiring channel 151 are formed. In some embodiments, the plug end 14 and the plug end 15 may be directly injection molded on the periphery of the wire 12 according to actual conditions, which is not specifically limited herein.

In some embodiments, the first wiring channel 141 may include a first wiring groove 1411 and a first wiring hole 1412 connecting with the first wiring groove 1411. The first wiring groove 1411 may be connected with the sidewall of the plug end 14. One end of the first wiring hole 1412 may be connected with one end of the first wiring groove 1411 and another end of the first wiring hole 1412 may be connected with the outer end surface of the plug end 14. The wire 12 at the plug end 14 may extend along the first wiring groove 1411 and the first wiring hole 1412 and be exposed on the outer end surface of the plug end 14 to further connect with other structures.

In some embodiments, the second wiring channel 151 may include a second wiring groove 1511 and a second wiring hole 1512 connecting with the second wiring groove 1511. The second wiring groove 1511 may be connected with the sidewall of the plug end 15, one end of the second wiring hole 1512 may be connected with one end of the second wiring groove 1511, and another end of the second wiring hole 1512 may be connected with the outer end surface of the plug end 15. The wire 12 at the plug end 15 may extend along the second wiring groove 1511 and the second wiring hole 1512 and be exposed on the outer end surface of the plug end 15 to further connect to other structures.

In some embodiments, the outer end surface of the plug end 14 refers to the surface of the end of the plug end 14 away from the plug end 15. The outer end surface of the plug end 15 refers to the surface of the end of the plug end 15 away from the plug end 14.

In some embodiments, the protective sleeve 16 may be injection molded around periphery of the elastic metal wire 11, the wire 12, the fixed sleeve 13, the plug end 14, and the plug end 15. Thus, the protective sleeve 16 may be fixedly connected with the elastic metal wire 11, the wire 12, the fixed sleeve 13, the plug end 14, and the plug end 15 respectively. There is no need to form the protective sleeve 16 separately by injection molding and then further wrap protective sleeve 16 around the periphery of the elastic metal wire 11, the plug end 14, and the plug end 15. It may simplify the manufacturing and assembly processes and make the fixation of the protective sleeve 16 more reliable and stable.

In some embodiments, when the protective sleeve 16 is formed, a housing sheath 17 disposed on the side close to the plug end 15 may be integrally formed with the protective sleeve 16. In some embodiments, the housing sheath 17 may be integrally formed with the protective sleeve 16 to form a whole structure. The circuit housing 30 may be connected to one end of the ear hook 10 by being fixedly connected to the plug end 15. The housing sheath 17 may be further wrapped around the periphery of the circuit housing 30 in a sleeved manner.

Specifically, when manufacturing the ear hook 10 of the MP3 player, the following steps may be implemented.

Step S101, the fixed sleeve 13 may be used to fix the wire 12 on the elastic metal wire 11. An injection position is reserved at both ends of the elastic metal wire 11. Specifically, the elastic metal wire 11 and the wire 12 may be placed side by side in a preset way, and then the fixed sleeve 13 is further sleeved around the wire 12 and the elastic metal wire 11, so as to fix the wire 12 on the elastic metal wire 11. Since the two ends of the elastic metal wire 11 still need the injection molded plug end 14 and the plug end 15, the two ends of the elastic metal wire 11 may not be completely wrapped by the fixed sleeve 13. A corresponding injection position needs to be reserved for injection molding of the plug end 14 and the plug end 15.

Step S102, the plug end 14 and the plug end 15 may be injection molded at the injection positions of the two ends of the elastic metal wire 11, respectively. The first wiring channel 141 and the second wiring channel 151 are arranged on the plug end 14 and the plug end 15, respectively.

Step S103, the wire 12 may be arranged to extend along the first wiring channel 141 and the second wiring channel 151. Specifically, after the forming of the plug end 14 and the plug end 15 is completed, the two ends of the wire 12 may be further threaded into the first wiring channel 141 and the second wiring channel 151 manually or by a machine. The part of the wire 12 located between the first wiring channel 141 and the second wiring channel 151 may be fixed on the elastic metal wire 11 by the fixed sleeve 13.

Step S104, the protective sleeve 16 may be formed by injection molding on the periphery of the elastic metal wire 11, the wire 12, the fixed sleeve 13, the plug end 14, and the plug end 15.

In some embodiments, when step S104 is performed, the housing sheath 17 may be integrally formed with the protective sleeve 16 on the periphery of the plug end 15 by injection molding.

In some embodiments, it should be noted that the wire 12 may not be arranged when the fixed sleeve 13 is installed. The wire 12 may be further arranged after the plug end 14 and the plug end 15 are injection molded. The specific steps are as follows.

Step S201, the fixed sleeve 13 may be sleeved on the elastic metal wire 11. The injection molding positions may be reserved at both ends of the elastic metal wire 11.

Step S202, the plug end 14 and the plug end 15 may be injection molded at the injection positions of the two ends of the elastic metal wire 11, respectively. The first wiring channel 141 and the second wiring channel 151 may be arranged on the plug end 14 and the plug end 15, respectively.

Step S203, the wire 12 may be threaded inside the fixed sleeve 13, so as to use the fixed sleeve 13 to fix the wire 12 on the elastic metal wire 11. Further, the wire 12 may be arranged to extend along the first wiring channel 141 and the second wiring channel 151.

It should be noted that, in this way, interference of the wire 12 may be avoided during injection molding of the plug end 14 and the plug end 15, so as to facilitate the smooth progress of molding.

It should be noted that the structure, function, and formation of the elastic metal wire 11, the wire 12, the fixed sleeve 13, the plug end 14, the plug end 15, and the protective sleeve 16 involved in the embodiment set forth above are the same as those in the foregoing embodiment, and for related details, please refer to the foregoing embodiment, which are not repeated herein.

In some embodiments, the core housing 20 may be used to accommodate the earphone core 50 and may be plugged and fixed with the plug end 14. The number of the earphone cores 50 and the core housings 20 are both two, corresponding to the left ear and the right ear of the user, respectively.

In some embodiments, the core housing 20 and the plug end 14 may be connected by plugging, clamping, etc., so as to fix the core housing 20 and the ear hook 10 together. That is, in this embodiment, the ear hook 10 and the core housing 20 may be formed separately first, and then be assembled together, instead of directly forming the two together.

In this way, the ear hook 10 and the core housing 20 may be molded separately with corresponding molds instead of using the same larger-sized mold to form the two integrally, which may reduce the size of the mold and the difficulty of mold process. In addition, since the ear hook 10 and the core housing 20 are processed by different molds, when the shape or structure of the ear hook 10 or the core housing 20 needs to be adjusted in the manufacturing process, it is sufficient to adjust the mold corresponding to the structure instead of adjusting the mold of another structure, so as to reduce the cost of production. In other embodiments, the ear hook 10 and the core housing 20 may be integrally formed according to the situation.

In some embodiments, the core housing 20 may be arranged with a socket 22 connecting with the outer end surface 21 of the core housing 20. The outer end surface 21 of the core housing 20 refers to the end surface of the core housing 20 facing the ear hook 10. The socket 22 provides an accommodating space for the plug end 14 of the ear hook 10 to be inserted into the core housing 20, so as to further realize the plug and fixation between the plug end 14 and the core housing 20.

Figure 5:
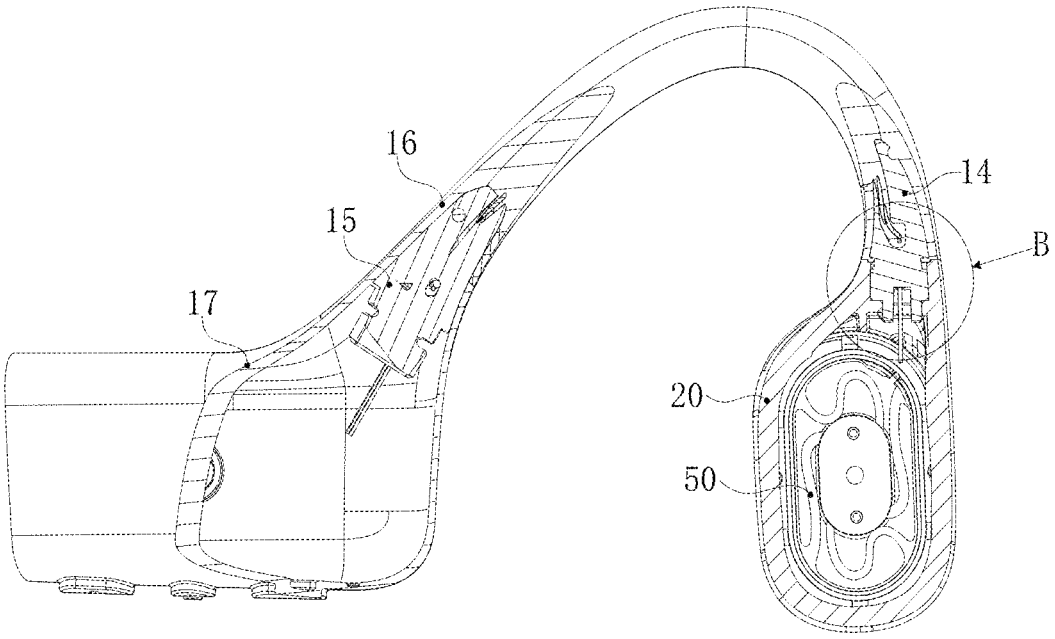
FIG. 5 is a partial sectional view of an MP3 player according to some embodiments of the present disclosure.
Figure 6:
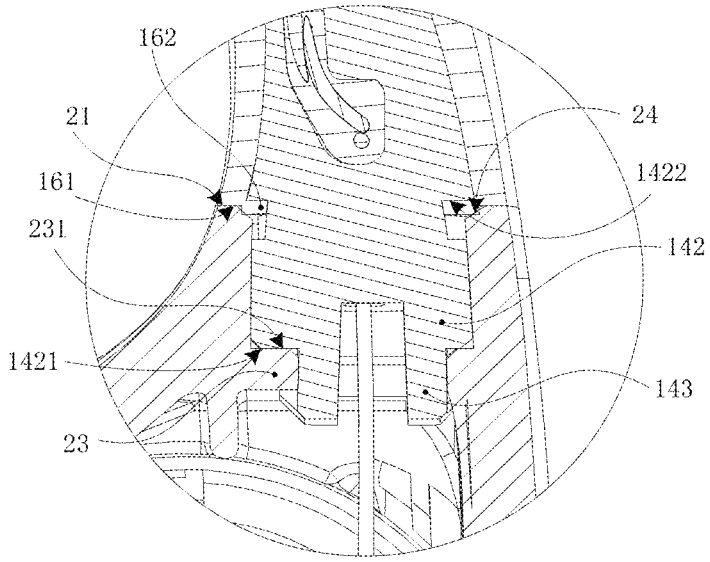
FIG. 6 is a partial enlarged view of part B in FIG. 5.

FIG. 5 is a partial sectional view of an MP3 player according to some embodiments of the present disclosure. FIG. 6 is a partial enlarged view of part B in FIG. 5.

Combining FIG. 2, FIG. 5, and FIG. 6, in some embodiments, the plug end 14 may include an inserting portion 142 and two elastic hooks 143. Specifically, the inserting portion 142 may be at least partially inserted into the socket 22 and abut against the outer side surface 231 of a stopping block 23. The shape of the outer sidewall of the inserting portion 142 matches the shape of the inner sidewall of the socket 22, so that the outer sidewall of the inserting portion 142 may abut against the inner sidewall of the socket 22 when the inserting portion 142 is at least partially inserted into the socket 22.

The outer side surface 231 of the stopping block 23 refers to a side of the stopping block 23 facing the ear hook 10. The inserting portion 142 may further include an end surface 1421 facing the core housing 20. The end surface 1421 may match the outer side surface 231 of the stopping block 23, so that the end surface 1421 of the inserting portion 142 may abut against the outer side surface 231 of the stopping block 23 when the inserting portion 142 is at least partially inserted into the socket 22.

In some embodiments, the two elastic hooks 143 may be arranged side by side and spaced apart symmetrically on the side of the inserting portion 142 facing the inside of the core housing 20 along the direction of insertion. The two elastic hooks 143 may be brought together under action of external thrust and the stopping block 23. After passing through the stopping block 23, the two elastic hooks 143 may be elastically restored to be stuck on an inner surface of the stopping block 23 to realize the fixation of the core housing 20 and the plug end 14. Each elastic hook 143 may include a beam portion 1431 and a hook portion 1432. The beam portion 1431 may be connected to the side of the inserting portion 142 facing the core housing 20. The hook portion 1432 may be arranged on the beam portion 1431 away from the inserting portion 142 and extend perpendicular to the inserted direction. Each hook portion 1432 may be arranged with a side parallel to the inserted direction and a transitional slope 14321 away from the inserting portion 142.

In some embodiments, after the core housing 20 and the plug end 14 are plugged and fixed, the inserting portion 142 may be partially inserted into the socket 22. The exposed portion of the inserting portion 142 may be arranged in a stepped manner, so as to form an annular table surfaces 1422 spaced apart from the outer end surface 21 of the core housing 20. The exposed portion of the inserting portion 142 refers to the portion of the inserting portion 142 exposed to the core housing 20. Specifically, the exposed portion of the inserting portion 142 refers to the portion exposed to the core housing 20 and close to the outer end surface of the core housing 20.

In some embodiments, the annular table surface 1422 may be arranged opposite to the outer end surface 21 of the core housing 20. The spacing between the two may refer to the spacing along the direction of insertion and the spacing perpendicular to the direction of insertion.

In some embodiments, the protective sleeve 16 may extend to the side of the annular table surface 1422 facing the outer end surface 21 of the core housing 20. When the socket 22 and the plug end 14 of the core housing 20 is plugged and fixed, the protective sleeve 16 may be at least partially filled in the space between the annular table surface 1422 and the outer end surface 21 of the core housing 20, and elastically abut against the core housing 20. Thus, it is difficult for external liquid to enter the inside of the core housing 20 from the junction between the plug end 14 and the core housing 20, thereby realizing the sealing between the plug end 14 and the socket 22, protecting the earphone core 50, etc. inside the core housing 20, and improving the waterproof effect of the bone conductive MP3 player.

Specifically, in some embodiments, the protective sleeve 16 forms an annular abutting surface 161 on the outer end surface 21 of the annular table surface 1422 facing the outer end surface of the core housing 20. The annular abutting surface 161 may be the end surface of the protective sleeve 16 facing the core housing 20.

In some embodiments, the protective sleeve 16 may further include an annular boss 162 locating inside the annular abutting surface 161 and protruding from the annular abutting surface 161. Specifically, the annular boss 162 may be formed on the side of the annular abutting surface 161 facing the plug end 14, and be protrudingly arranged toward the core housing 20 relative to the annular abutting surface 161. Further, the annular boss 162 may also be directly formed on the periphery of the annular table surface 1422 and cover the annular table surface 1422.

In some embodiments, the core housing 20 may include a connecting slope 24 for connecting the outer end surface 21 of the core housing 20 and the inner sidewall of the socket 22. The connecting slope 24 may be the transitional surface between the outer end surface 21 of the core housing 20 and the inner sidewall of the socket 22. The connecting slope 24 may be not on the same plane as the outer end surface 21 of the core housing 20 and the inner sidewall of the socket 22. In some embodiments, the connecting slope 24 may be a flat surface, or may also be a curved surface or other shapes according to actual requirements, there is no specific limitation herein.

Specifically, when the core housing 20 and the plug end 14 are plugged and fixed, the annular abutting surface 161 and the annular boss 162 may elastically abut against the outer end surface of the core housing 20 and the connecting slope 24, respectively. It should be noted that since the outer end surface 21 of the core housing 20 and the connecting slope 24 are not on the same plane, the elastic abutment between the protective sleeve 16 and the core housing 20 may be not on the same plane. Thus, it is difficult for external liquid to enter the core housing 20 from the junction of the protective sleeve 16 and the core housing 20, and further enter the earphone core 50, so as to improve the waterproof effect of the MP3 player, protect the inner functional structure, and extend the lifetime of the MP3 player.

In some embodiments, the inserting portion 142 may be further formed with an annular groove 1423 adjacent to the annular table surface 1422 on the side of the annular table surface 1422 facing the outer end surface 21 of the core housing 20. The annular boss 162 may be formed in the annular groove 1423.

In some embodiments, an end of the wire 12 of the ear hook 10 arranged outside the core housing 20 may pass through the second wiring channel 151 to connect the circuits outside the core housing 20, such as the control circuit 60, the battery 70, etc. included in the circuit housing 30. Another end of the wire 12 may be exposed to the outer end surface of the plug end 14 along the first wiring channel 141, and further enter the core housing 20 through the socket 22 along with the inserting portion 142.

Figure 7:
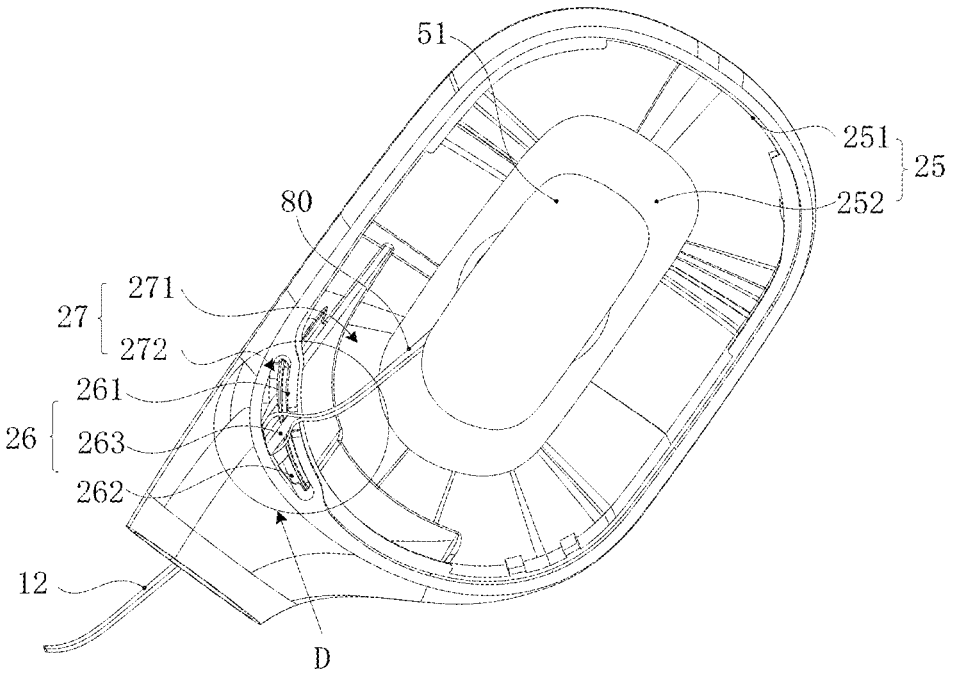
FIG. 7 is a partial structural diagram of a core housing according to some embodiments of the present disclosure.
Figure 8:
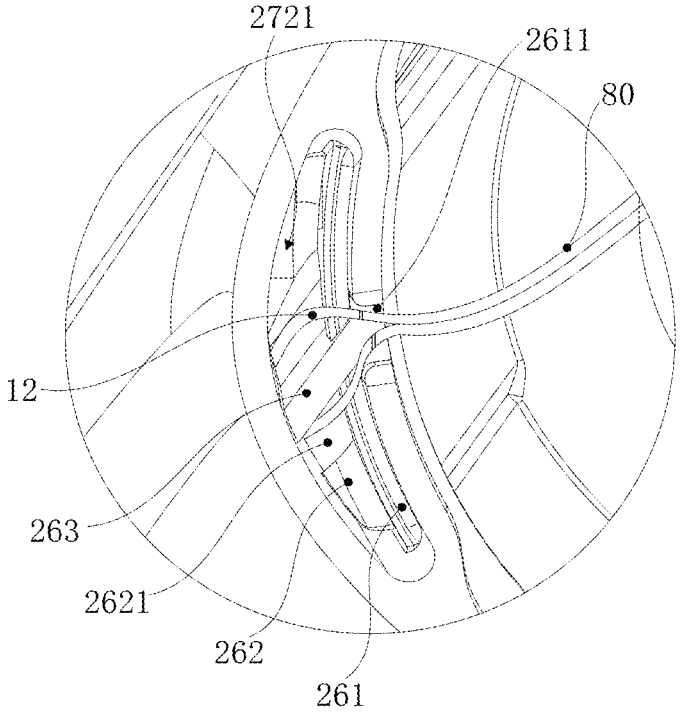
FIG. 8 is a partial enlarged view of part D in FIG. 7.
Figure 9:
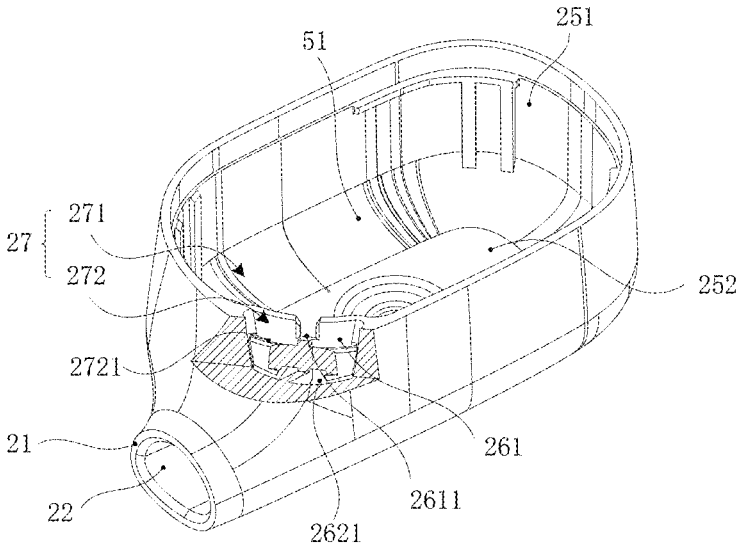
FIG. 9 is a partial sectional view of a core housing according to some embodiments of the present disclosure.

FIG. 7 is a partial structural diagram of the core housing according to some embodiments of the present disclosure. FIG. 8 is a partial enlarged view of part D in FIG. 7. FIG. 9 is a partial sectional view of a core housing according to some embodiments of the present disclosure.

Combing FIG. 2, FIG. 7, FIG. 8, and FIG. 9, in some embodiments, the core housing 20 may include a main housing 25 and a partition component 26. The partition component 26 may be arranged inside the main housing 25 and connected to the main housing 25, so as to divide the inner space 27 of the main housing 25 into a first accommodating space 271 and a second accommodating space 272 on the side close to the socket 22. In some embodiments, the main housing 25 may include a peripheral sidewall 251 and a bottom wall 252 connected to one end surface of the peripheral sidewall 251. The peripheral sidewall 251 and the bottom wall 252 jointly form the inner space 27 of the main housing.

The partition component 26 may be arranged on the side of the main housing 25 close to the socket 22 and include a side partition 261 and a bottom partition 262. The side partition 261 may be arranged in a direction perpendicular to the bottom wall 252 and both ends of the side partition 261 may be connected with the peripheral sidewall 251, thereby separating the inner space 27 of the main housing 25. The bottom partition 262 and the bottom wall 252 may be parallel or nearly parallel and spaced apart. Further, the bottom partition 262 and the bottom wall 252 may be connected to the peripheral side wall 251 and the side partition 261, respectively. Thus, the inner space 27 formed by the main housing 25 may be divided into two to form the first accommodating space 271 surrounded by the side partition 261, the bottom partition 262, the peripheral sidewall 251 away from the socket 22, and the bottom wall 252, and the second accommodating space 272 surrounded by the bottom partition 262, the side partition 261, and the peripheral sidewall 251 close to the socket 22. The second accommodating space 272 may be smaller than the first accommodating space 271. The partition component 26 may also divide the inner space 27 of the main housing 25 by other arrangements, which are not specifically limited herein.

In some embodiments, the earphone core may include a functional component 51 that may be arranged in the first accommodating space 271 and used for vibrating and generating sound. In some embodiments, the MP3 player may further include a wire 80 connected to the functional component 51. An end of the wire 80 may be extended from the first accommodating space 271 to the second accommodating space 272.

In some embodiments, the side partition 261 may be arranged with a wiring groove 2611 at the top edge away from the bottom wall 252. The wiring groove 2611 may connect the first accommodation space 271 and the second accommodation space 272. Further, an end of the wire 12 away from the functional component may extend into the second accommodating space 272 through the wire groove 2611.

After the end of the wire 12 away from the circuit housing 30 entering the core housing 20 with the inserting portion 142, the end of the wire 12 may further extend into the second accommodating space 272 and be electrically connected to the wire 80 in the second accommodating space 272, so that a wire path connecting the first accommodating space 271 to an external circuit through the second accommodating space 272 may be formed. Thus, the functional component 51 may be electrically connected to the external circuit arranged outside the core housing 20 through the wire path.

In some embodiments, the bottom partition 262 may also be arranged with a wiring hole 2621, which connects the socket 22 with the second accommodating space 272, so that the wire 12 entering the core housing from the socket 22 may extend to the second accommodating space 272 through the wiring hole 2621.

The wire 12 and the wire 80 may be coiled and arranged in the second accommodating space 272 after being connected in the second accommodating space 272. Specifically, the wire 12 and the wire 80 may be connected together by welding. Further, the functional component 51 may be electrically connected to the external circuit, so as to provide power for the normal operation of the functional component 51 through the external circuit or transmit data to the earphone core 50.

It should be noted that when assembling the bone conductive MP3 player, the wire is often longer than the actual requirement to facilitate assembly. However, if the extra wires of the earphone core 50 may not be placed reasonably, it is easy to vibrate and make abnormal noises when the functional component 51 is working, thereby reducing the sound quality of the bone conductive MP3 player and affecting the user's experience of listening. In this embodiment, the second accommodating space 272 may be separated from the inner space 27 formed by the main housing 25 of the core housing 20 and used for accommodating extra wires 12 and wires 80, so as to avoid or reduce the influence of the extra wires on the sound generated by the bone conductive MP3 player due to vibration, thereby improving the sound quality.

In some embodiments, the partition component 26 may further include an inner partition 263. The inner partition 263 may further divide the second accommodating space 272 into two sub-accommodating spaces 2721. Specifically, the inner partition 263 may be arranged perpendicular to the bottom wall 252 of the main housing 25 and connected to the side partition 261 and the peripheral sidewall 251 respectively, and further extend to the wiring hole 2621, so as to divide the wiring hole 2621 into two, while dividing the second accommodating space 272 into two sub-accommodating spaces 2721. Each of the two wiring holes 2621 may be connected with a corresponding sub-accommodating space 2721 respectively.

In this embodiment, there are two wires 12 and two wires 80. The two wires 12 may extend into respective sub-accommodating spaces 2721 along the corresponding wiring holes 2621 respectively. The two wires 80 may enter the second accommodating space 272 through the wiring groove 2611 together, separate after entering the second accommodating space 272, be welded with the corresponding wires 12 in the corresponding sub-accommodating spaces 2721 respectively, and further be coiled and arranged in the corresponding sub-accommodating space 2721.

In some embodiments, the second accommodating space 272 may be further filled with sealant. In this way, the wire 12 and the wire 80 included in the second accommodating space 272 may be further fixed, which may reduce the adverse effect on the sound quality caused by the vibration of the wire, improve the sound quality of the bone conductive MP3 player, and protect the welding point between the wire 12 and the wire 80. In addition, the purpose of waterproof and dustproof may also be achieved by sealing the second accommodating space 272.

Referring to FIG. 2 and FIG. 3, in some embodiments, the circuit housing 30 and the plug end 15 may be plugged and fixed, so that the circuit housing 30 may be fixed to the end of the ear hook 10 away from the core housing 20. When worn by the user, the circuit housing 30 including the battery 70 and the circuit housing 30 including the control circuit 60 may correspond to the left and right side of the user, respectively. The way of plug and connection of the circuit housing 30 and the control circuit 60 may be different from the corresponding plug end 15.

Specifically, the circuit housing 30 may be connected to the plug end 15 through plug and connection, snap connection, or the like. In other words, in this embodiment, the ear hook 10 and the circuit housing 30 may be formed separately, and then be assembled after the form is completed, instead of directly forming the two together.

In this way, the ear hook 10 and the circuit housing 30 may be molded separately with respective corresponding molds, instead of using the same larger-sized mold to form the two integrally, which may reduce the size of the molding mold and the difficulty of mold process. In addition, since the ear hook 10 and the circuit housing 30 are processed by different molds, when the shape or structure of the ear hook 10 or the circuit housing 30 needs to be adjusted in the manufacturing process, it is sufficient to adjust the mold corresponding to the structure. There is no need to adjust the mold corresponding to another structure, so as to reduce the cost of production.

In some embodiments, the circuit housing 30 may be arranged with a socket 31. The shape of the inner surface of the socket 31 may match the shape of at least part of the outer end surface of the plug end 15, so that the plug end 15 may be at least partially inserted into the socket 31.

Further, a slot 152 perpendicular to the inserted direction of the plug end 15 with respect to the socket 31 may be arranged on opposite sides of the plug end 15, respectively. Specifically, the two slots 152 may be symmetric and spaced apart on opposite sides of the plug end 15, and both are connected to the sidewall of the plug end 15 in the vertical direction along the inserted direction.

Referring to FIG. 2, the circuit housing 30 may be flat. For example, the cross-section of the circuit housing 30 at the second socket 31 may be elliptical or other shapes that may be flattened. In this embodiment, the two opposite sidewalls of the circuit housing 30 with a larger area are main sidewalls 33 and the two opposite sidewalls with a smaller area connecting the two main sidewalls 33 are auxiliary sidewalls 34.

It should be noted that the above description of the MP3 player is only a specific example and should not be regarded as the only feasible implementation solution. Obviously, for those skilled in the art, after understanding the basic principles of the MP3 player, various modifications and changes in forms and details of the specific methods and steps for implementing the MP3 player may be made without departing from the principles. However, those modifications and changes are still within the scope described above. For example, the number of the fixed sleeves 13 is not limited to the at least two described in the embodiments set forth above. The number of the fixed sleeves 13 may also be one, which may be specifically determined according to actual requirements. As another example, the shape of the cross-section of the circuit housing 30 at the socket 31 is not limited to be elliptical. The shape of the cross-section may also be other shapes, such as a triangle, a quadrilateral, a pentagon, and other polygons. Such modifications are all within the protection scope of the present disclosure.

Figure 10:
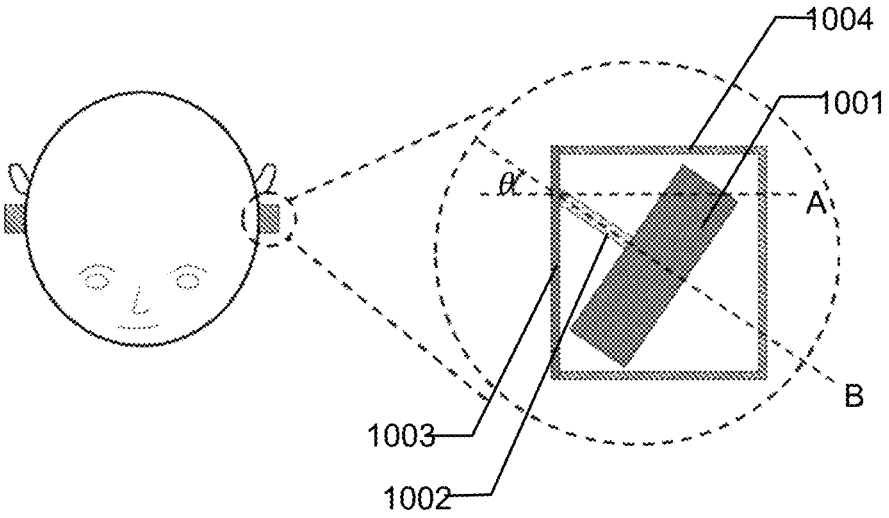
FIG. 10 is a structural diagram and an application scenario of a bone conductive loudspeaker apparatus according to some embodiments of the present disclosure.

FIG. 10 is a structural diagram and an application scenario of a bone conductive loudspeaker according to some embodiments of the present disclosure. Please refer to FIG. 10 and FIG. 2. The housing 1004 in FIG. 10 may be equivalent to the core housing 20 in FIG. 2 and the driving device 1001 in FIG. 10 may be equivalent to the earphone core 50 in FIG. 2. In the following, the bone conductive loudspeaker only is used as an example to describe the application scenario and structure of the loudspeaker apparatus. In some embodiments, as shown in FIG. 10, the bone conductive loudspeaker may include a driving device 1001, a transmission component 1002, a panel 1003 (the panel 1003 may also be referred to as a housing panel, which is the side of the core housing 20 facing the human body), and a housing 1004, etc. In some embodiments, the housing 1004 may include a housing back and a housing side. The panel 1003 may be connected with the housing back and the housing side. The driving device 1001 may transmit the vibrating signal to the panel 1003 and/or the housing 1004 through the transmission component 1002, and further transmit the sound to the human body by contacting with the panel 1003 or the housing 1004 and human skin. In some embodiments, the panel 1003 and/or the housing 1004 of the bone conductive loudspeaker may be in contact with human skin at the tragus, so as to transmit sound to the human body. In some embodiments, the panel 1003 and/or the housing 1004 may also be in contact with human skin on the backside of the auricle.

In some embodiments, a straight line B (or a vibrating direction of a driving device) of a driving force generated by the driving component 1001 and a normal line A of the panel 1003 may form an angle θ. In other words, the straight line B is not parallel to the normal line A.

The panel has an area that contacts or abuts the user's body, such as human skin. It should be understood that when the panel is covered with other materials (such as silicone and other soft materials) to enhance the user's wearing comfortability, the panel and the user's body are not in direct contact, but abut against each other. In some embodiments, when the bone conductive loudspeaker is worn on the user's body, the whole area of the panel contacts or abuts the user's body. In some embodiments, when the bone conductive loudspeaker is worn on the user's body, a part of the panel contacts or abuts the user's body. In some embodiments, the area of the panel contacting or abutting the user's body may account for more than 50% of the entire area of the panel. More preferably, it may account for more than 60% of the entire area of the panel. In general, the area of the panel contacting or abutting the user's body may be flat or curved.

In some embodiments, when the area of the panel contacting or abutting the user's body is a flat surface, its normal line meets the general definition, that is, a dashed line perpendicular to the flat surface. In some embodiments, when the area contacting or abutting the user's body of the panel is a curved surface, its normal line is the average normal line of the area, wherein, the average normal line is defined as follows:

$$\hat{r}_0 = \frac{\oiint_S \hat{r}\,ds}{\left|\oiint_S \hat{r}\,ds\right|}, \tag{1}$$

where, $\hat{r}_0$ refers to the average normal line; $\hat{r}$ refers to the normal line of any point on the curved surface; ds refers to a surface unit.

Further, the curved surface is a quasi-flat surface that is close to the flat surface. That is, the curved surface is a surface that an angle between a normal line of any point of at least 50% of the area on the curved surface and the average normal line is less than a set threshold. In some embodiments, the set threshold may be less than 10°. In some embodiments, the set threshold may be less than 5°.

In some embodiments, the straight line B of the driving force and the normal line A' of the area of the panel 1003 for contacting or abutting the user's body may form the angle θ. A value range of the angle θ may be 0<θ<180°. Further, the value range may be 0<θ<180° and not equal to 90°. In some embodiments, it is assumed that the straight line B has a positive direction pointing to the outside of the bone conductive loudspeaker, and the normal line A of the panel 1003 (or the normal line A' of a contact surface of the panel 1003 and the human skin) also has a positive direction pointing to the outside of the bone conductive loudspeaker. Thus, the angle θ formed by the normal line A or A' and the straight line B in the positive direction is an acute angle, that is, 0<θ<90°. More descriptions about the normal line A and A' may be found in FIG. 12 and the descriptions thereof.

Figure 11:
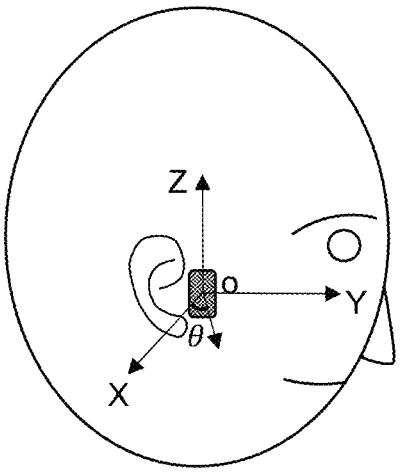
FIG. 11 is a schematic diagram illustrating a direction of an included angle according to some embodiments of the present disclosure.

FIG. 11 is a schematic diagram illustrating a direction of an included angle according to some embodiments of the present disclosure. As shown in FIG. 11, in some embodiments, a driving force generated by a driving device has a component in a first quadrant and/or a third quadrant of a XOY plane coordinate system. As used herein, the XOY plane coordinate system is a reference coordinate system whose origin O is located on a contact surface between the panel and/or the housing and the human body after the bone conductive loudspeaker is worn on the human body. The X axis is parallel to the coronal axis of the human body, the Y axis is parallel to the sagittal axis of the human body, and the positive direction of the X axis faces the outside of the human body, the positive direction of the Y axis faces the front of the human body. Quadrants should be understood as four regions divided by the horizontal axis (such as X axis) and the vertical axis (such as Y axis) in a rectangular coordinate system. Each region is a quadrant. The quadrant is centered at the origin, and the X axis and Y axis are the dividing lines. The upper right region (the region enclosed by the positive half axis of the X axis and the positive half axis of the Y axis) is the first quadrant, the upper left region (the region enclosed by the negative half axis of the X axis and the positive half axis of the Y axis) is the second quadrant, the lower left region (the region enclosed by the positive half axis of the X axis and the negative half axis of the Y axis) is the third quadrant, and the lower right region (the region enclosed by the positive half axis of the X axis and the negative half axis of the Y axis) is the fourth quadrant. The points on the X axis and the Y axis do not belong to any quadrant. It should be understood that the driving force in the embodiment may be directly located in the first quadrant and/or the third quadrant of the XOY plane coordinate system, or the driving force may point to other directions, but the projection or component in the first quadrant and/or the third quadrant is not equal to 0 in the XOY plane coordinate system, and the projection or component in a direction of a Z axis may be equal to 0 or not equal to 0. As used herein, the Z axis is perpendicular to the XOY plane and passes through the origin O. In some embodiments, the angle θ between the straight line of the driving force and the normal line of the area contacting or abutting the user's body of the panel may be any acute angle, for example, the range of the angle θ is 5°~80°. More preferably, the range is 15°~70°. More preferably, the range is 25°~60°. More preferably, the range is 25°~50°. More preferably, the range is 28°~50°. More preferably, the range is 30°~39°. More preferably, the range is 31°~38°. More preferably, the range is 32°~37°. More preferably, the range is 33°~36°. More preferably, the range is 33°~35.8°. More preferably, the range is 33.5°~35°. Specifically, the angle θ may be 26°, 27°, 28°, 29°, 30°, 31°, 32°, 33°, 34°, 34.2°, 35°, 35.8°, 36°, 37°, 38°, etc., wherein the error is controlled within 0.2°. It should be noted that the illustrations of the driving force direction described above should not be interpreted as a limitation of the driving force in the present disclosure. In other embodiments, the driving force may also have component in the second and fourth quadrants of the XOY plane coordinate system, even the driving force may be located on the Y axis, or the like.

Figure 12:
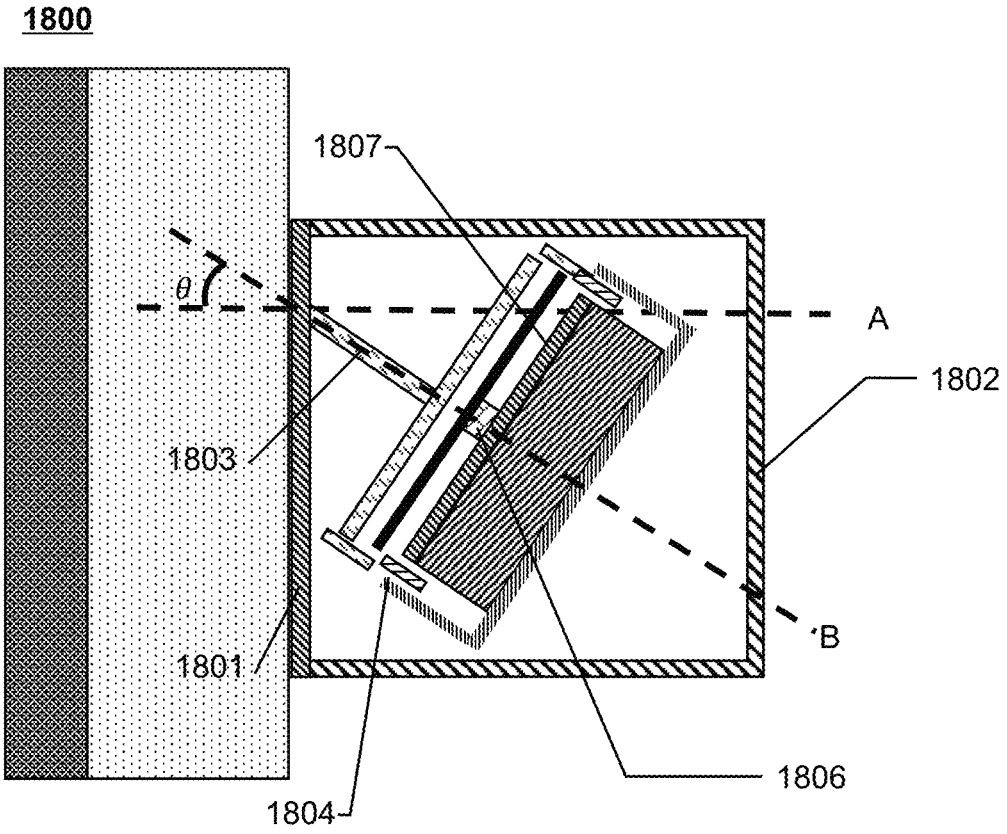
FIG. 12 is a structural diagram of a bone conductive loudspeaker apparatus acting on human skin and bones according to the present disclosure.

FIG. 12 is a structural diagram of a bone conductive loudspeaker acting on human skin and bones according to the present disclosure.

In some embodiments, the straight line of the driving force is collinear or parallel to the straight line of the vibration of the driving device. For example, in a driving device based on the moving-coil principle, the direction of the driving force may be the same as or opposite to the vibrating direction of the coil and/or the magnetic circuit component. The panel may have a flat surface or curved surface, or there are a plurality of protrusions or grooves on the panel. In some embodiments, when the bone conductive loudspeaker is worn on the user's body, the normal line of the area contacting or abutting the user's body of the panel is not parallel to the straight line of the driving force. In general, the area contacting or abutting the user's body of the panel is flat relatively. Specifically, it may have a flat surface or a quasi-flat plane with little curvature. When the area contacting or abutting the user's body of the panel has a flat surface, the normal line of any point on it may be the normal line of the area. At this time, the normal line A of the panel 1003 may be parallel or coincident to the normal line A' of the contact surface between the panel 1003 and human skin. When the panel used to contact the user's body is non-planar, the normal line of the area may be the average normal line. More detailed definitions of the average normal line may be found in FIG. 10 and the descriptions thereof. In some other embodiments, when the panel used to contact the user's body is non-planar, the normal line of the area may also be determined as follows: selecting a certain point in an area when the panel is in contact with human skin, determining a tangent plane of the panel at the selected point, determining a straight line that passes through the point and is perpendicular to the tangent plane, and designating the straight line as the normal line of the panel. When the panel used to contact the user's body is non-planar, different points correspond to different tangent planes of the panel, and the determined normal line may also be different. At this time, the normal line A' is not parallel to the normal line A of the panel. According to a specific embodiment of the present disclosure, the straight line of the driving force (or the straight line of the vibration of the driving device) and the normal line of the area may form an angle θ, where 0<θ<180°. In some embodiments, when the straight line of the driving force has a positive direction pointing to the outside of the bone conductive loudspeaker from the panel (or the contact surface between the panel and/or the housing and human skin), and the normal line of the designated panel (or the contact surface between the panel and/or the housing and human skin) has a positive direction pointing to the outside of the bone conductive loudspeaker, the angle formed by the two straight lines in the positive direction is an acute angle.

As shown in FIG. 12, the bone conductive loudspeaker may include a driving device (also referred to as a transducer in other embodiments), a transmission component 1803, a panel 1801, and a housing 1802. In some embodiments, a coil 1804 and a magnetic circuit component 1807 are both ring-shaped. In some embodiments, the driving device adopts a moving-coil driving mode, and includes the coil 1804 and the magnetic circuit component 1807.

In some embodiments, the coil 1804 and the magnetic circuit component 1807 have axes parallel to each other. The axis of the coil 1804 or the magnetic circuit component 1807 is perpendicular to the radial plane of the coil 1804 and/or the magnetic circuit component 1807. In some embodiments, the coil 1804 and the magnetic circuit component 1807 have the same central axis. The central axis of the coil 1804 is perpendicular to the radial plane of the coil 1804 and passes through the geometric center of the coil 1804. The central axis of the magnetic circuit component 1807 is perpendicular to the radial plane of the magnetic circuit component 1807 and passes through the geometric center of the magnetic circuit component 1807. The axis of the coil 1804 or the magnetic circuit component 1807 and the normal line of the panel 1801 may form the angle θ described above.

Merely by way of example, the relationship between the driving force F and the deformation S of the skin will be illustrated below combined with FIG. 12. When the straight line of the driving force generated by the driving device is parallel to the normal line of the panel 1801 (i.e., the angle θ is zero), the relationship between the driving force and the total deformation of the skin is:

$$F_{\perp}=S_{\perp}\times E\times A/h \quad (2),$$

where, $F_{\perp}$ refers to the driving force, $S_{\perp}$ refers to the total deformation of the skin in the direction perpendicular to the skin, E refers to the elastic modulus of the skin, A refers to the contact area between the panel and the skin, h refers to a total thickness of the skin (i.e., the distance between the panel and the bone).

When the straight line of the driving force generated by the driving device is parallel to the normal line of the area contacting or abutting the user's body of the panel (i.e., the angle θ is 90°), the relationship between the driving force in the vertical direction and the total deformation of the skin may be shown in Equation (3):

$$F_{\parallel}=S_{\parallel}\times G\times A/h \quad (3),$$

where, $F_{\parallel}$ refers to the driving force, $S_{\parallel}$ refers to the total deformation of the skin in the direction parallel to the skin, G refers to the shear modulus of the skin, A refers to the contact area between the panel and the skin, h refers to total thickness of the skin (i.e., the distance between the panel and the bone).

The relationship between the shear modulus G and the elastic modulus E is:

$$G=E/2(1+\gamma) \quad (4),$$

where, γ refers to the Poisson's ratio of the skin $0<\gamma<0.5$. Thus the shear modulus G is less than the elastic modulus E, and under the same driving force, the corresponding total deformation of the skin $S_{||}>S_{\perp}$. Generally, the Poisson's ratio of the skin is close to 0.4.

When the straight line of the driving force generated by the driving device is not parallel to the normal line of the area contacting or abutting the user's body of the panel, the driving force in the horizontal direction and the driving force in the vertical direction are expressed as the Equation (5) and Equation (6), respectively:

$$F_{\perp}=F\times\cos(\theta) \quad (5),$$

$$F_{||}=F\times\sin(\theta) \quad (6),$$

where, the relationship between the driving force F and the deformation S of the skin may be shown in the following equation:

$$S=\sqrt[2]{S_{\perp}^2+S_{//}^2}=\frac{h}{A}\times F\times\sqrt[2]{(\cos(\theta)/E)^2+(\sin(\theta)/G)^2}. \quad (7)$$

When the Poisson's ratio is 0.4, the descriptions regarding the relationship between the angle θ and the total deformation of the skin may be found elsewhere of the present disclosure.

Figure 13:
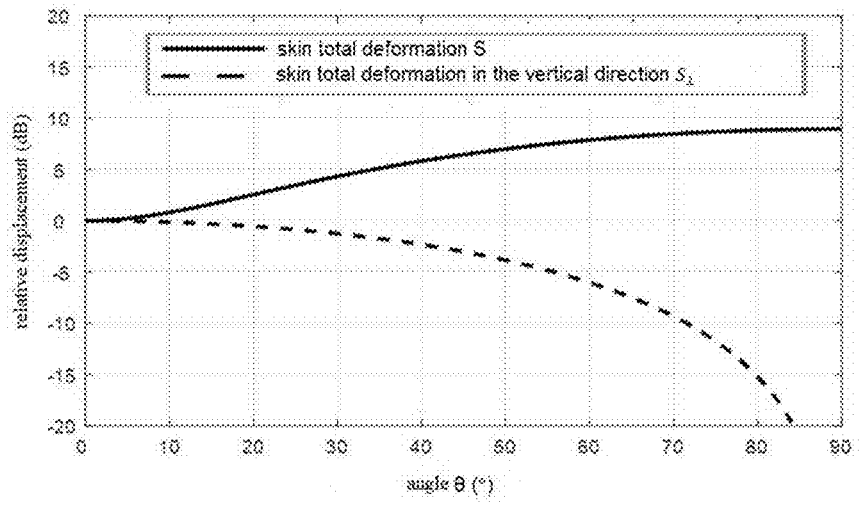
FIG. 13 is a diagram illustrating an angle-relative displacement relationship of a bone conductive loudspeaker apparatus according to some embodiments of the present disclosure.

FIG. 13 is a diagram illustrating an angle-relative displacement relationship of a bone conductive loudspeaker according to some embodiments of the present disclosure. As shown in FIG. 13, the relationship between the angle θ and the total deformation of the skin is that the greater the angle θ, and the greater the relative displacement, the greater the total deformation S of the skin. The greater the angle θ, and the less the relative displacement, the less the deformation $S_{\perp}$ of the skin in the vertical direction of the skin. When the angle θ is close to 90°, the deformation $S_{\perp}$ of the skin in the vertical direction of the skin gradually tends to 0.

The volume of the bone conductive loudspeaker in the low frequency part is positively correlated with the total deformation of the skin S. The larger the S, the larger the volume of the bone conductive loudspeaker in low frequency. The volume of the bone conductive loudspeaker in the high frequency part is positively correlated with the deformation $S_{\perp}$ of the skin in the vertical direction of the skin. The larger the $S_{\perp}$, the larger the volume of the bone conductive loudspeaker in low frequency.

Figure 22:
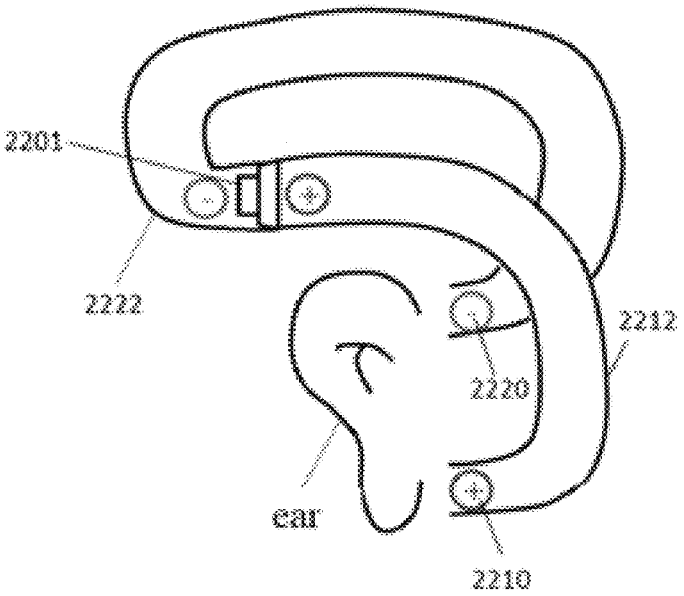
FIG. 22 is a schematic diagram illustrating transmitting a sound through air conduction according to some embodiments of the present disclosure.

When the Poisson's ratio of the skin is 0.4, the detailed illustration of the relationship between the angle θ and total deformation of the skin S, the deformation $S_{\perp}$ of the skin in the vertical direction of the skin may be found in FIG. 13. As shown in FIG. 13, the relationship between the angle θ and the total deformation of the skin S is that the larger the angle θ and the larger the total deformation of the skin S, the larger the volume of the corresponding bone conductive loudspeaker in the low frequency part. As shown in FIG. 22, the relationship between the angle θ and the deformation $S_{\perp}$ of the skin in the vertical direction of the skin is that the larger the angle θ and the smaller the deformation $S_{\perp}$ of the skin in the vertical direction of the skin, the smaller the volume of the corresponding bone conductive loudspeaker in the high frequency part.

It may be seen from Equation (7) and curves in FIG. 13 that with the increase of the angle θ, the speed at which the total deformation of the skin S increases is different from the speed at which the deformation $S_{\perp}$ of the skin in the vertical direction of the skin decreases. The speed at which the total deformation of the skin S increases becomes faster at first, and then becomes slower, and the speed at which the deformation $S_{\perp}$ of the skin in the vertical direction of the skin decreases becomes faster and faster. In order to balance the volume of the bone conductive loudspeaker in the low frequency part and the high frequency part, the angle θ should be at an appropriate value, for example, within a range of θ is 5°~80°, 15°~70°, 25°~50°, 25°~35°~30°, or the like.

Figure 14:
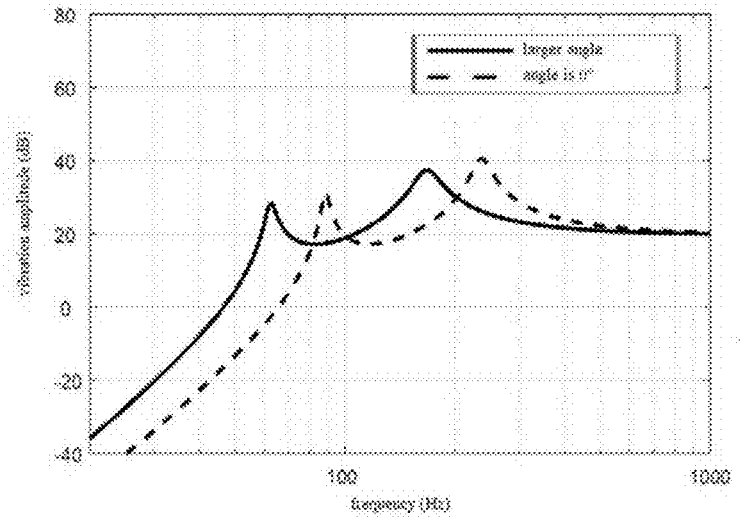
FIG. 14 is a schematic diagram illustrating frequency response curves of a bone conductive loudspeaker apparatus in a low-frequency part correspond to different angles 8 according to some embodiments in the present disclosure.

FIG. 14 is a schematic diagram illustrating frequency response curves of a bone conductive loudspeaker in a low-frequency part correspond to different angles θ according to some embodiments in the present disclosure. As shown in FIG. 14, the panel is in contact with the skin and transmits vibration to the skin. During this process, the skin may also affect the vibration of the bone conductive loudspeaker, so as to affect the frequency response curve of the bone conductive loudspeaker. From the above analysis, it is found that the larger the included angle, the larger the total deformation of the skin under the same driving force, and for the bone conductive loudspeaker, it is equivalent to that the elasticity of the skin relative to the panel decreases. It may be further understood that when a certain angle θ is formed between the straight line of the driving force generated by the driving device and the normal line of the area contacting or abutting the user's body of the panel. Especially when the angle θ increases, the resonance peak in the low frequency area of the frequency response curve may be adjusted to a lower frequency area, thus making the low frequency to dive deeper and increasing signals in the low frequencies. Compared with other techniques to improve the low frequency components of the sound (e.g., adding a vibration transmission plate to the bone conductive loudspeaker), setting the included angle may suppress the increase of the vibration effectively while increasing the energy of the low frequency, so as to reduce the sense of vibration, which improves the sensitivity of the low frequency of the bone conductive loudspeaker significantly, and improves the sound quality and human experience. It should be noted that, in some embodiments, the increase of the low frequency and the reduction of the vibration may be expressed as when the angle θ increases in the range of (0, 90°), the energy in the range of the low frequency of the vibration or the sound signal(s) increases, and the sense of vibration also increases, but the degree of energy increase in the low frequency range is greater than the degree of vibration sensation increase. Thus, in relative effect, the vibration sensation is reduced relatively. It may be seen in FIG. 14, when the included angle is relatively large, the resonance peak in the low frequency area may appear in a lower frequency range, which extends the flat part of the frequency curvature, so as to improve the sound quality of the loudspeaker.

It should be noted that the illustration of the bone conductive loudspeaker described above is only a specific example, and should not be regarded as the only feasible implementation. Obviously, for those skilled in the art, after the basic principles of the bone conductive loudspeaker, it may be possible to make various modifications and changes in forms and details of the specific methods and steps for implementing the bone conductive loudspeaker without departing from the principles, but the modifications and changes are still within the scope illustrated above. For example, the minimum angle θ between the straight line of the driving force generated by the driving device and the normal line of the area contacting or abutting the user's body of the panel may be any acute angle. The acute angle herein is not limited to 5°~80° described above. The angle θ may be less than 5°, such as 1°, 2°, 3°, 4°, etc. In other embodiments, the angle θ may be larger than 80° and less than 90°, such as 81°, 82°, 85°, etc. In some embodiments, the specific value of the angle θ may not be an integer (e.g., 81.3°、81.38°). Such deformations are all within the protection scope of the present disclosure.

Figure 15:
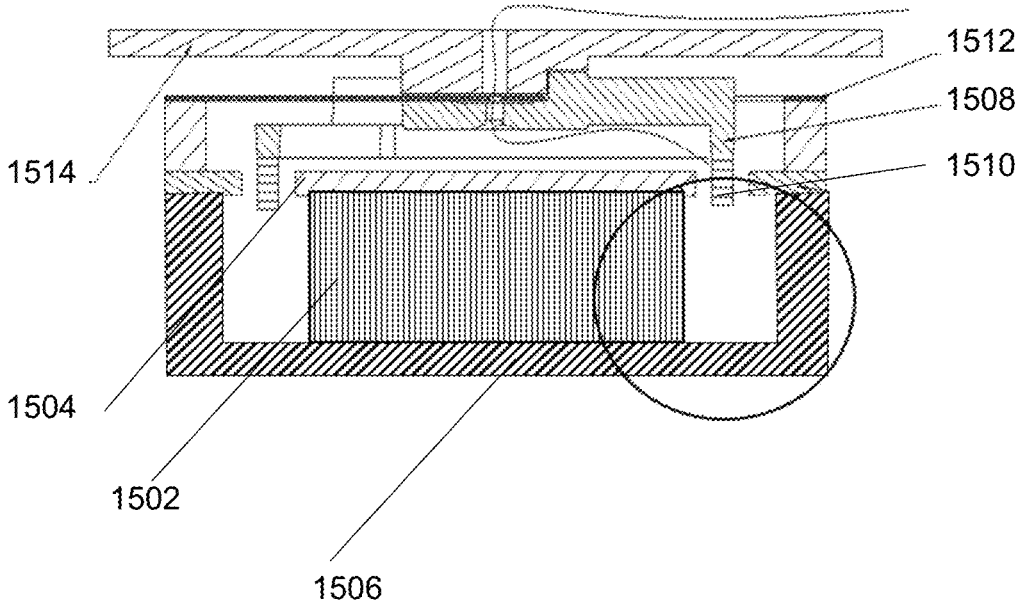
FIG. 15 is a longitudinal section view illustrating a bone conductive loudspeaker apparatus according to some embodiments of the present disclosure.

FIG. 15 is a longitudinal sectional view illustrating a loudspeaker apparatus according to some embodiments of the present disclosure. As shown in FIG. 15, the speaker may include a first magnetic unit 1502, a first magnetically conductive unit 1504, a second magnetically conductive unit 1506, a first vibration plate 1508, a voice coil 1510, a second vibration plate 1512, and a vibration panel 1514. As used herein, some units of the earphone core of the loudspeaker apparatus may correspond to the magnetic circuit component. In some embodiments, the magnetic circuit component may include the first magnetic unit 1502, the first magnetically conductive unit 1504, and the second magnetically conductive unit 1506. The magnetic circuit component may generate a first full magnetic field (also referred to "total magnetic field of the magnetic circuit component" or "first magnetic field").

The magnetic unit described in the present disclosure may refer to a unit that may generate a magnetic field, such as a magnet. The magnetic unit may have a magnetization direction. The magnetization direction may refer to a direction of a magnetic field inside the magnetic unit. In some embodiments, the first magnetic unit 302 may include one or more magnets. The first magnetic unit may generate a second magnetic field. In some embodiments, the magnet may include a metal alloy magnet, ferrite, or the like. The metal alloy magnet may include neodymium iron boron, samarium cobalt, aluminum nickel cobalt, iron chromium cobalt, aluminum iron boron, iron carbon aluminum, or the like, or any combination thereof. Ferrite may include barium ferrite, steel ferrite, manganese ferrite, lithium manganese ferrite, or the like, or any combination thereof.

In some embodiments, a lower surface of the first magnetically conductive unit 1504 may be connected to an upper surface of the first magnetic unit 1502. The second magnetically conductive unit 1506 may be connected to the first magnetic unit 1502. It should be noted that the magnetically conductive unit herein may also refer to a magnetic field concentrator or an iron core. The magnetically conductive unit may adjust a distribution of a magnetic field (e.g., a second magnetic field generated by the first magnetic unit 1502). The magnetically conductive unit may include a unit made of a soft magnetic material. In some embodiments, the soft magnetic material may include metal materials, metal alloys, metal oxide materials, amorphous metal materials, etc., such as iron, iron-silicon alloys, iron-aluminum alloys, nickel-iron alloys, iron-cobalt series alloys, low carbon steel, silicon steel sheet, silicon steel sheet, ferrite, etc. In some embodiments, the magnetically conductive unit may be processed by casting, plastic processing, cutting processing, powder metallurgy, or the like, or any combination thereof. The casting may include sand casting, investment casting, pressure casting, centrifugal casting, etc. The plastic processing may include rolling, casting, forging, stamping, extrusion, drawing, or the like, or any combination thereof. The cutting processing may include turning, milling, planning, grinding, or the like. In some embodiments, the processing method of the magnetically conductive unit may include 3D printing, CNC machine tools, or the like. A connection manner between the first magnetically conductive unit 1504, the second magnetically conductive unit 1506, and the first magnetic unit 1502 may include bonding, snapping, welding, riveting, bolting, or the like, or any combination thereof. In some embodiments, the first magnetic unit 1502, the first magnetically conductive unit 1504, and the second magnetically conductive unit 1506 may be disposed as an axisymmetric structure. The axisymmetric structure may be a ring structure, a columnar structure, or other axisymmetric structures.

In some embodiments, a magnetic gap may form between the first magnetic unit 1502 and the second magnetically conductive unit 1506. The voice coil 1510 may be disposed in the magnetic gap. The voice coil 1510 may be connected to the first vibration plate 1508. The first vibration plate 1508 may be connected to the second vibration plate 1512. The second vibration plate 1512 may be connected to the vibration panel 1514. When a current is passed into the voice coil 1510, the voice coil 1510 may be located in a magnetic field formed by the first magnetic unit 1502, the first magnetically conductive unit 1504, and the second magnetically conductive unit 1506, and applied to an ampere force. The ampere force may drive the voice coil 1510 to vibrate, and the vibration of the voice coil 1510 may drive the vibration of the first vibration plate 1508, the second vibration plate 1512, and the vibration panel 1514. The vibration panel 1514 may transmit the vibration to auditory nerves through tissues and bones, so that a person may hear a sound. The vibration panel 1514 may be in direct contact with human skins, or contact with the skins through a vibration transmission layer made of a specific material.

In some embodiments, for a loudspeaker apparatus with a single magnetic unit, magnetic induction line(s) passing through the voice coil may not be uniform and divergent. At the same time, magnetic leakage may form in the magnetic circuit. That is, more magnetic induction lines may leak outside the magnetic gap and fail to pass through the voice coil. As a result, a magnetic induction strength (or magnetic field strength) at the position of the voice coil may decrease, which may affect the sensitivity of the loudspeaker apparatus. Therefore, the loudspeaker apparatus 100 may further include at least one second magnetic unit and/or at least one third magnetically conductive unit (not shown in figures). The at least one second magnetic unit and/or at least one third magnetically conductive unit may suppress the leakage of the magnetic induction lines and restrict the shape of the magnetic induction lines passing through the voice coil. Therefore, more magnetic induction lines may pass through the voice coil as horizontally and densely as possible to increase the magnetic induction strength (or magnetic field strength) at the position of the voice coil, thereby increasing the sensitivity of the loudspeaker apparatus, and further improving the mechanical conversion efficiency of the loudspeaker apparatus (i.e., the efficiency of converting the input power of the loudspeaker apparatus into the mechanical energy of the vibration of the voice coil).

Figure 16:
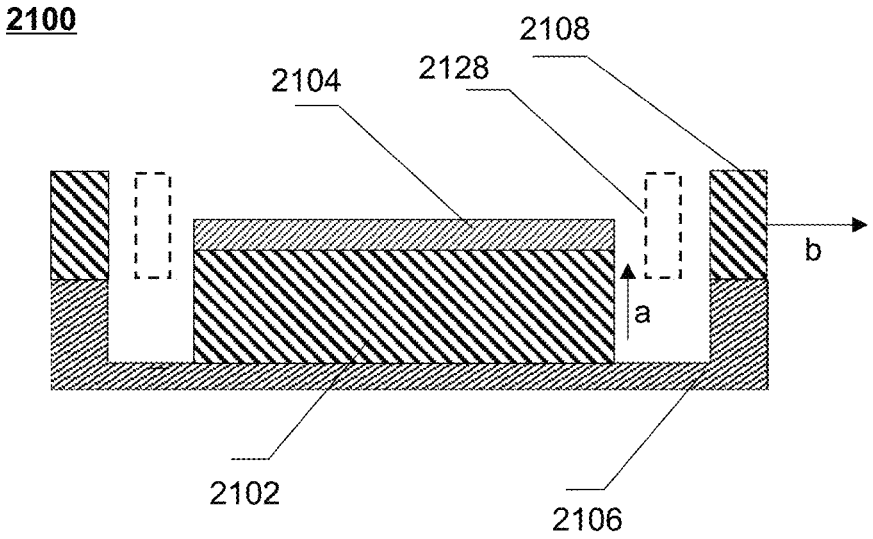
FIG. 16 is a longitudinal sectional view illustrating a magnetic circuit component 2100 according to some embodiments of the present disclosure.

FIG. 16 is a longitudinal sectional view illustrating a magnetic circuit component 2100 according to some embodiments of the present disclosure. As shown in FIG. 16, the magnetic circuit component 2100 may include a first magnetic unit 2102, a first magnetically conductive unit 2104, a second magnetically conductive unit 2106, and a second magnetic unit 2108. In some embodiments, the first magnetic unit 2102 and/or the second magnetic unit 2108 may include any one or more magnets described in the present disclosure. In some embodiments, the first magnetic unit 2102 may include a first magnet, and the second magnetic unit 2108 may include a second magnet. The first magnet may be the same as or different from the second magnet. The first magnetically conductive unit 2104 and/or the second magnetically conductive unit 2106 may include any one or more magnetically conductive materials described in the present disclosure. The processing manner of the first magnetically conductive unit 2104 and/or the second magnetically conductive unit 2106 may include any one or more processing manners described in the present disclosure. In some embodiments, the first magnetic unit 2102 and/or the first magnetically conductive unit 2104 may be disposed as an axisymmetric structure. For example, the first magnetic unit 2102 and/or the first magnetically conductive unit 2104 may be a cylinder, a cuboid, or a hollow ring (e.g., the cross-section is a shape of the runway). In some embodiments, the first magnetic unit 2102 and the first magnetically conductive unit 2104 may be coaxial cylinders with the same or different diameters. In some embodiments, the second magnetically conductive unit 2106 may be a groove-type structure. The groove-type structure may include a U-shaped section (as shown in FIG. 15). The groove-type second magnetically conductive unit 2106 may include a bottom plate and a side wall. In some embodiments, the bottom plate and the side wall may be integrally formed as a whole. For example, the side wall may be formed by extending the bottom plate in a direction perpendicular to the bottom plate. In some embodiments, the bottom plate may be connected to the side wall through any one or more connection manners described in the present disclosure. The second magnetic unit 2108 may be disposed as a ring shape or a sheet shape. In some embodiments, the second magnetic unit 2108 may be the ring shape. The second magnetic unit 2108 may include an inner ring and an outer ring. In some embodiments, the shape of the inner ring and/or the outer ring may be a ring, an ellipse, a triangle, a quadrangle, or any other polygons. In some embodiments, the second magnetic unit 2108 may be formed by arranging a number of magnets. Both ends of any one of the number of magnets may be connected to or have a certain distance from both ends of an adjacent magnet. The spacing between the magnets may be the same or different. In some embodiments, the second magnetic unit 2108 may be formed by arranging two or three sheet-shaped magnets equidistantly. The shape of the sheet-shaped magnet may be fan-shaped, a quadrangular shape, or the like. In some embodiments, the second magnetic unit 2108 may be coaxial with the first magnetic unit 2102 and/or the first magnetically conductive unit 2104.

In some embodiments, the upper surface of the first magnetic unit 2102 may be connected to the lower surface of the first magnetically conductive unit 2104. The lower surface of the first magnetic unit 2102 may be connected to the bottom plate of the second magnetically conductive unit 306. The lower surface of the second magnetic unit 2108 may be connected to the side wall of the second magnetically conductive unit 2106. The connection manners between the first magnetic unit 2102, the first magnetically conductive unit 2104, the second magnetically conductive unit 2106, and/or the second magnetic unit 2108 may include bonding, snapping, welding, riveting, bolting, or the like, or any combination thereof.

In some embodiments, a magnetic gap may be formed between the first magnetic unit 2102 and/or the first magnetically conductive unit 2104 and the inner ring of the second magnetic unit 2108. A voice coil 2128 may be disposed in the magnetic gap. In some embodiments, heights of the second magnetic unit 2108 and the voice coil 2128 relative to the bottom plate of the second magnetically conductive unit 2106 may be equal. In some embodiments, the first magnetic unit 2102, the first magnetically conductive unit 2104, the second magnetically conductive unit 2106, and the second magnetic unit 2108 may form a magnetic circuit. In some embodiments, the magnetic circuit component 2100 may generate a first full magnetic field (also referred to "total magnetic field of magnetic circuit component" or "first magnetic field"). The first magnetic unit 2102 may generate a second magnetic field. The first full magnetic field may be formed by magnetic fields generated by all components (e.g., the first magnetic unit 2102, the first magnetically conductive unit 2104, the second magnetically conductive unit 2106, and the second magnetic unit 2108) in the magnetic circuit component 2100. The magnetic field strength of the first full magnetic field in the magnetic gap (also referred to as magnetic induction strength or magnetic flux density) may be greater than the magnetic field strength of the second magnetic field in the magnetic gap. In some embodiments, the second magnetic unit 2108 may generate a third magnetic field. The third magnetic field may increase the magnetic field strength of the first full magnetic field in the magnetic gap. The third magnetic field increasing the magnetic field strength of the first full magnetic field herein may mean that the magnetic strength of the first full magnetic field in the magnetic gap when the third magnetic field exists (i.e., the second magnetic unit 2108 exists) may be greater than that of the first full magnetic field when the third magnetic field does not exist (i.e., the second magnetic unit 2108 does not exist). In other embodiments of the specification, unless otherwise specified, the magnetic circuit component may mean a structure including all magnetic units and magnetically conductive units. The first full magnetic field may represent the magnetic field generated by the magnetic circuit component as a whole. The second magnetic field, the third magnetic field, . . . , and the N-th magnetic field may respectively represent the magnetic fields generated by the corresponding magnetic units. In different embodiments, the magnetic unit that generates the second magnetic field (the third magnetic field, . . . , or the N-th magnetic field) may be the same or different.

In some embodiments, an included angle between a magnetization direction of the first magnetic unit 2102 and a magnetization direction of the second magnetic unit 2108 may be between 0 degrees and 180 degrees. In some embodiments, the included angle between the magnetization direction of the first magnetic unit 2102 and the magnetization direction of the second magnetic unit 2108 may be between 45 degrees and 135 degrees. In some embodiments, the induced angle between the magnetization direction of the first magnetic unit 2102 and the magnetization direction of the second magnetic unit 2108 may be equal to or greater than 90 degrees. In some embodiments, the magnetization direction of the first magnetic unit 2102 may be perpendicular to the lower surface or the upper surface of the first magnetic unit 302 and be vertically upward (as shown by the direction a in the figure). The magnetization direction of the second magnetic unit 2108 may be directed from the inner ring of the second magnetic unit 2108 to the outer ring (as shown by the direction b on the right side of the first magnetic unit 2102 in the figure, the magnetization direction of the first magnetic unit 2102 may deflect 90 degrees in a clockwise direction).

In some embodiments, at the position of the second magnetic unit 2108, an included angle between the direction of the first full magnetic field and the magnetization direction of the second magnetic unit 2108 may not be greater than 90 degrees. In some embodiments, at the position of the second magnetic unit 2108, the included angle between the direction of the magnetic field generated by the first magnetic unit 2102 and the direction of the magnetization of the second magnetic unit 2108 may be less than or equal to 90 degrees, such as 0 degrees, 10 degrees, 20 degrees, or the like.

Compared with a magnetic circuit component with a single magnetic unit, the second magnetic unit 2108 may increase the total magnetic flux in the magnetic gap of the magnetic circuit component 2100, thereby increasing the magnetic induction intensity in the magnetic gap. And, under the action of the second magnetic unit 2108, originally scattered magnetic induction lines may converge to the position of the magnetic gap, further increasing the magnetic induction intensity in the magnetic gap.

Figure 17:
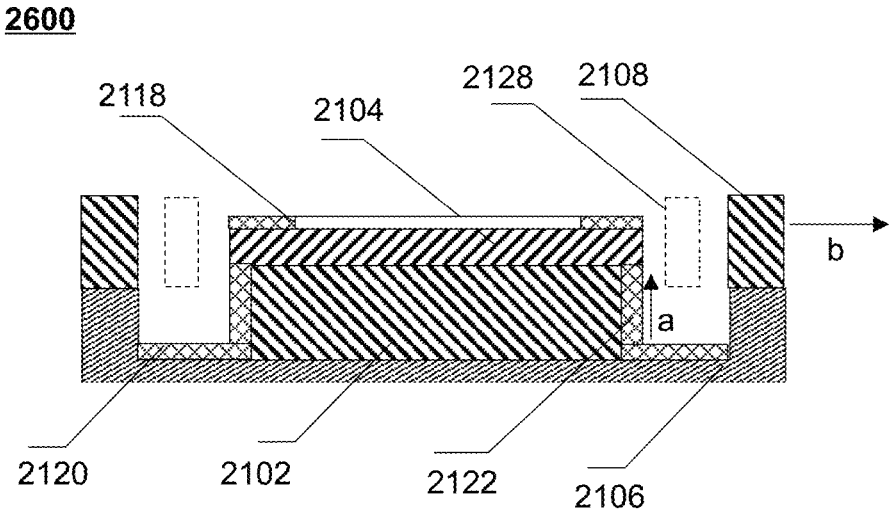
FIG. 17 is a longitudinal sectional view illustrating a magnetic circuit component 2600 according to some embodiments of the present disclosure.

FIG. 17 is a longitudinal sectional view illustrating a magnetic circuit component 2600 according to some embodiments of the present disclosure. As shown in FIG. 17, different from the magnetic circuit component 2100, the magnetic circuit component 2600 may further include at least one electrically conductive unit (e.g., a first electrically conductive unit 2118, a second electrically conductive unit 2120, and a third electrically conductive unit 2122).

The electrically conductive unit may include a metal material, a metal alloy material, an inorganic non-metal material, or other conductive materials. The metal material may include gold, silver, copper, aluminum, etc. The metal alloy material may include an iron-based alloy, an aluminum-based alloy material, a copper-based alloys, a zinc-based alloys, etc. The inorganic non-metal material may include graphite, etc. The electrically conductive unit may be a sheet shape, a ring shape, a mesh shape, or the like. The first electrically conductive unit 2118 may be disposed on an upper surface of the first magnetically conductive unit 2104. The second electrically conductive unit 2120 may be connected to the first magnetic unit 2102 and the second magnetically conductive unit 2106. The third electrically conductive unit 2122 may be connected to a side wall of the first magnetic unit 2102. In some embodiments, the first magnetically conductive unit 2104 may protrude from the first magnetic unit 2102 to form a first concave portion. The third electrically conductive unit 2122 may be disposed on the first concave portion. In some embodiments, the first electrically conductive unit 2118, the second electrically conductive unit 2120, and the third electrically conductive unit 2122 may include the same or different conductive materials. The first electrically conductive unit 2118, the second electrically conductive unit 2120, and the third electrically conductive unit 2122 may be respectively connected to the first magnetically conductive unit 2104, the second magnetically conductive unit 2106 and/or the first magnetic unit 2102 through any one or more connection manners described in the present disclosure.

A magnetic gap may be formed between the first magnetic unit 2102, the first magnetically conductive unit 2104, and the inner ring of the second magnetic unit 2108. A voice coil 2128 may be disposed in the magnetic gap. The first magnetic unit 2102, the first magnetically conductive unit 2104, the second magnetically conductive unit 2106, and the second magnetic unit 2108 may form a magnetic circuit. In some embodiments, the electrically conductive unit may reduce an inductive reactance of the voice coil 2128. For example, if a first alternating current flows through the voice coil 2128, a first alternating induced magnetic field may be generated near the voice coil 2128. Under the action of the magnetic field in the magnetic circuit, the first alternating induced magnetic field may cause the inductive reactance of the voice coil 2128 and hinder the movement of the voice coil 2128. When an electrically conductive unit (e.g., the first electrically conductive unit 2118, the second electrically conductive unit 2120, and the third electrically conductive unit 2122) is disposed near the voice coil 2128, the electrically conductive unit may induce a second alternating current under the action of the first alternating induced magnetic field. A third alternating current in the electrically conductive unit may generate a second alternating induced magnetic field near the third alternating current. The second alternating induction magnetic field may be opposite to the first alternating induction magnetic field, and weaken the first alternating induction magnetic field, thereby reducing the inductive reactance of the voice coil 2128, increasing the current in the voice coil, and improving the sensitivity of the speaker.

Figure 18:
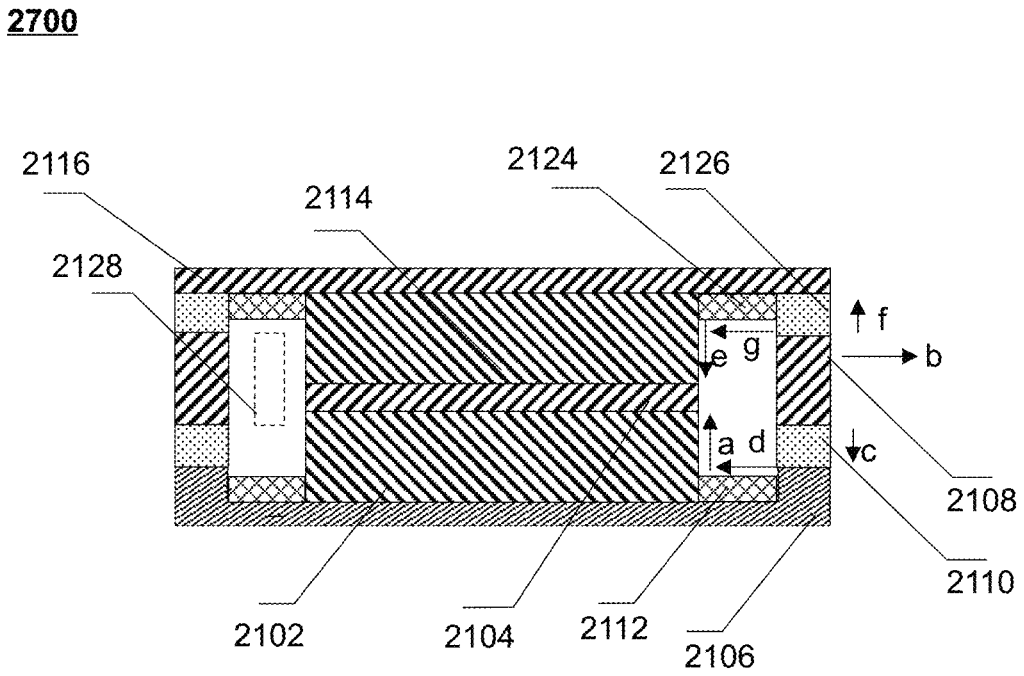
FIG. 18 is a longitudinal sectional view illustrating a magnetic circuit component 2700 according to some embodiments of the present disclosure.

FIG. 18 is a longitudinal sectional view illustrating a magnetic circuit component 2700 according to some embodiments of the present disclosure. As shown in FIG. 18, different from the magnetic circuit component 2500, the magnetic circuit component 2700 may further include a third magnetic unit 2110, a fourth magnetic unit 2112, a fifth magnetic unit 2114, a third magnetically conductive unit 2116, a sixth magnetic unit 2124, and a seventh magnetic unit 2126. The third magnetic unit 2110, the fourth magnetic unit 2112, the fifth magnetic unit 2114, the third magnetically conductive unit 2116 and/or the sixth magnetic unit 2124, and the seventh magnetic unit 2126 may be disposed as coaxial ring cylinders.

In some embodiments, an upper surface of the second magnetic unit 2108 may be connected to the seventh magnetic unit 2126. A lower surface of the second magnetic unit 2108 may be connected to the third magnetic unit 2110. The third magnetic unit 2110 may be connected to the second magnetically conductive unit 2106. An upper surface of the seventh magnetic unit 2126 may be connected to the third magnetically conductive unit 2116. The fourth magnetic unit 2112 may be connected to the second magnetically conductive unit 2106 and the first magnetic unit 2102. The sixth magnetic unit 2124 may be connected to the fifth magnetic unit 2114, the third magnetically conductive unit 2116, and the seventh magnetic unit 2126. In some embodiments, the first magnetic unit 2102, the first magnetically conductive unit 2104, the sixth magnetic unit 2124, the second magnetically conductive unit 2106, the second magnetic unit 2108, the third magnetic unit 2110, the fourth magnetic unit 2112, the fifth magnetic unit 2114, the third magnetically conductive unit 2116, and the seventh magnetic unit 2126 may form a magnetic circuit and a magnetic gap.

In some embodiments, an included angle between a magnetization direction of the first magnetic unit 2102 and a magnetization direction of the sixth magnetic unit 2124 may be between 0 degrees and 180 degrees. In some embodiments, the included angle between the magnetization direction of the first magnetic unit 2102 and the magnetization direction of the sixth magnetic unit 2124 may be between 45 degrees and 135 degrees. In some embodiments, the included angle between the magnetization direction of the first magnetic unit 2102 and the magnetization direction of the sixth magnetic unit 2124 may not be higher than 90 degrees. In some embodiments, the magnetization direction of the first magnetic unit 2102 may be perpendicular to a lower surface or an upper surface of the first magnetic unit 2102 and be vertically upward (as shown by the direction a in the figure). The magnetization direction of the sixth magnetic unit 2124 may be directed from an outer ring of the sixth magnetic unit 2124 to an inner ring (as shown by the direction g on the right side of the first magnetic unit 2102 in the figure, the magnetization direction of the first magnetic unit 2102 may deflect 270 degrees in a clockwise direction). In some embodiments, the magnetization direction of the sixth magnetic unit 2124 may be the same as that of the fourth magnetic unit 2112 in the same vertical direction.

In some embodiments, at the position of the sixth magnetic unit 2124, an included angle between the direction of the magnetic field generated by the magnetic circuit component 2700 and the magnetization direction of the sixth magnetic unit 2124 may not be higher than 90 degrees. In some embodiments, at the position of the sixth magnetic unit 2124, the included angle between the direction of the magnetic field generated by the first magnetic unit 2102 and the magnetized direction of the sixth magnetic unit 2124 may be less than or equal to 90 degrees, such as 0 degrees, 10 degrees, or 20 degrees.

In some embodiments, the included angle between the magnetization direction of the first magnetic unit 2102 and the magnetization direction of the seventh magnetic unit 2126 may be between 0 degrees and 180 degrees. In some embodiments, the included angle between the magnetization direction of the first magnetic unit 2102 and the magnetization direction of the seventh magnetic unit 2126 may be between 45 degrees and 135 degrees. In some embodiments, the included angle between the magnetization direction of the first magnetic unit 2102 and the magnetization direction of the seventh magnetic unit 2126 may not be higher than 90 degrees. In some embodiments, the magnetization direction of the first magnetic unit 2102 may be perpendicular to a lower surface or an upper surface of the first magnetic unit 2102 and be vertically upward (as shown by the direction a in the figure). The magnetization direction of the seventh magnetic unit 2126 may be directed from the lower surface of the seventh magnetic unit 2126 to the upper surface (as shown in the direction f on the right side of the first magnetic unit 2102 in the figure, the magnetization direction of the first magnetic unit 2102 may deflect 360 degrees in a clockwise direction). In some embodiments, the magnetization direction of the seventh magnetic unit 2126 may be opposite to that of the third magnetic unit 2110.

In some embodiments, at the position of the seventh magnetic unit 2126, the included angle between the direction of the magnetic field generated by magnetic circuit component 2700 and the direction of magnetization of the seventh magnetic unit 2126 may not be higher than 90 degrees. In some embodiments, at the position of the seventh magnetic unit 2126, the included angle between the direction of the magnetic field generated by the first magnetic unit 2102 and the magnetized direction of the seventh magnetic unit 2126 may be less than or equal to 90 degrees, such as 0 degrees, 10 degrees, or 20 degrees.

In the magnetic circuit component 2700, the third magnetically conductive unit 2116 may close the magnetic circuit generated by the magnetic circuit component 2700, so that more magnetic induction lines may be concentrated in the magnetic gap, thereby implementing the effect of suppressing the magnetic leakage, increasing the magnetic induction strength in the magnetic gap, and improving the sensitivity of the loudspeaker apparatus.

Figure 19:
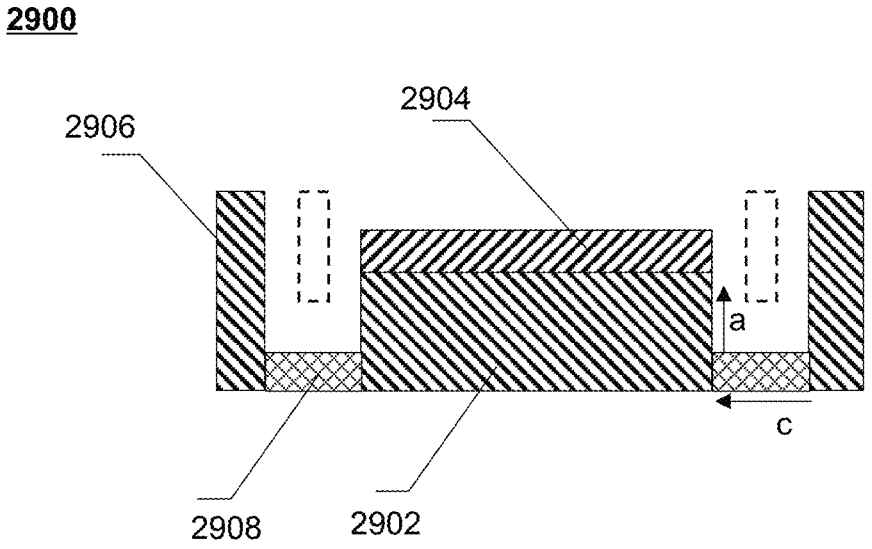
FIG. 19 is a longitudinal sectional view illustrating a magnetic circuit component 2900 according to some embodiments of the present disclosure.

FIG. 19 is a longitudinal sectional view illustrating a magnetic circuit component 2900 according to some embodiments of the present disclosure. As shown in FIG. 19, the magnetic circuit component 2900 may include a first magnetic unit 2902, a first magnetically conductive unit 2904, a first full magnetic field changing unit 2906, and a second magnetic unit 2908.

An upper surface of the first magnetic unit 2902 may be connected to a lower surface of the first magnetically conductive unit 2904. The second magnetic unit 2908 may be connected to the first magnetic unit 2902 and the first full magnetic field changing unit 2906. The connection manners between the first magnetic unit 2902, the first magnetically conductive unit 2904, the first full magnetic field changing unit 2906, and/or the second magnetic unit 2908 may be based on any one or more connection manners described in the present disclosure. In some embodiments, the first magnetic unit 2902, the first magnetically conductive unit 2904, the first full magnetic field changing unit 2906, and/or the second magnetic unit 2908 may form a magnetic circuit and a magnetic gap.

In some embodiments, the magnetic circuit component 2900 may generate a first full magnetic field. The first magnetic unit 2902 may generate a second magnetic field. A magnetic field intensity of the first full magnetic field in the magnetic gap may be greater than the magnetic field intensity of the second magnetic field in the magnetic gap. In some embodiments, the second magnetic unit 2908 may generate a third magnetic field. The third magnetic field may increase a magnetic field strength of the second magnetic field in the magnetic gap.

In some embodiments, the included angle between the magnetization direction of the first magnetic unit 2902 and the magnetization direction of the second magnetic unit 2908 may be between 0 degrees and 180 degrees. In some embodiments, the included angle between the magnetization direction of the first magnetic unit 2902 and the magnetization direction of the second magnetic unit 2908 may be between 45 degrees and 135 degrees. In some embodiments, the included angle between the magnetization direction of the first magnetic unit 2902 and the magnetization direction of the second magnetic unit 2908 may not be higher than 90 degrees.

In some embodiments, at the position of the second magnetic unit 2908, the included angle between a direction of the first full magnetic field and the magnetization direction of the second magnetic unit 2908 may not be higher than 90 degrees. In some embodiments, at the position of the second magnetic unit 2908, the included angle between the direction of the magnetic field generated by the first magnetic unit 2902 and the direction of magnetization of the second magnetic unit 2908 may be a less than or equal to 90 degrees, such as 0 degrees, 10 degrees, or 20 degrees. As another example, the magnetization direction of the first magnetic unit 2902 may be perpendicular to the lower surface or the upper surface of the first magnetic unit 2902 and be vertically upward (as shown by the direction a in the figure). The magnetization direction of the second magnetic unit 2908 may be directed from the outer ring of the second magnetic unit 2908 to the inner ring (as shown by the direction c on the right side of the first magnetic unit 2902 in the figure, the magnetization direction of the first magnetic unit 2902 may deflect 270 degrees in a clockwise direction).

Compared with a magnetic circuit component with a single magnetic unit, the first full magnetic field changing unit 2906 in the magnetic circuit component 2900 may increase the total magnetic flux in the magnetic gap, thereby increasing the magnetic induction intensity in the magnetic gap. And, under the action of the first full magnetic field changing unit 2906, originally scattered magnetic induction lines may converge to the position of the magnetic gap, further increasing the magnetic induction intensity in the magnetic gap.

Figure 20:
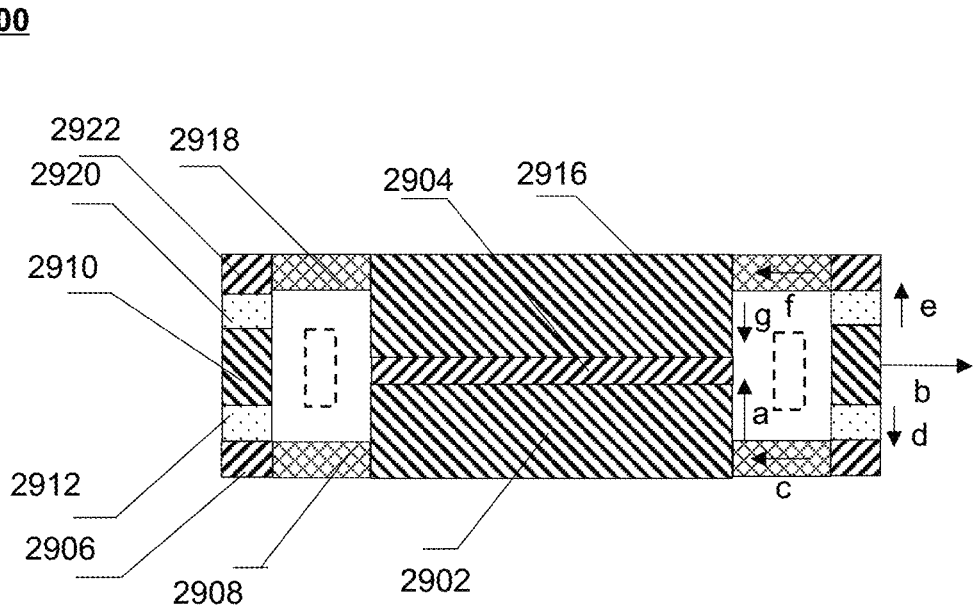
FIG. 20 is a longitudinal sectional view illustrating a magnetic circuit component 3000 according to some embodiments of the present disclosure.

FIG. 20 is a longitudinal sectional view illustrating a magnetic circuit component 3000 according to some embodiments of the present disclosure. As shown in FIG. 20, in some embodiments, the magnetic circuit component 3000 may include the first magnetic unit 2902, a first magnetically conductive unit 2904, a first full magnetic field changing unit 2906, a second magnetic unit 2908, a third magnetic unit 2910, a fourth magnetic unit 2912, a fifth magnetic unit 2916, a sixth magnetic unit 2918, a seventh magnetic unit 2920, and a second ring unit 2922. In some embodiments, the first full magnetic field changing unit 2906 and/or the second ring unit 2922 may include a ring-shaped magnetic unit or a ring-shaped magnetically conductive unit. The ring-shaped magnetic unit may include any one or more magnetic materials described in the present disclosure. The ring-shaped magnetically conductive unit may include any one or more magnetically conductive materials described in the present disclosure.

In some embodiments, the sixth magnetic unit 2918 may be connected to the fifth magnetic unit 2916 and the second ring unit 2922. The seventh magnetic unit 2920 may be connected to the third magnetic unit 2910 and the second ring unit 2922. In some embodiments, the first magnetic unit 2902, the fifth magnetic unit 2916, the second magnetic unit 2908, the third magnetic unit 2910, the fourth magnetic unit 2912, the sixth magnetic unit 2918, and/or the seventh magnetic unit 2920, the first magnetically conductive unit 2904, the first full magnetic field changing unit 2906, and the second ring unit 2922 may form a magnetic circuit.

In some embodiments, an included angle between the magnetization direction of the first magnetic unit 2902 and a magnetization direction of the sixth magnetic unit 2918 may be between 0 degrees and 180 degrees. In some embodiments, the angle between the magnetization direction of the first magnetic unit 2902 and the magnetization direction of the sixth magnetic unit 2918 may be between 45 degrees and 135 degrees. In some embodiments, the included angle between the magnetization direction of the first magnetic unit 2902 and the magnetization direction of the sixth magnetic unit 2918 may not be higher than 90 degrees. In some embodiments, the magnetization direction of the first magnetic unit 2902 may be perpendicular to the lower surface or the upper surface of the first magnetic unit 2902 and be vertically upward (as shown by the direction a in the figure). The magnetization direction of the sixth magnetic unit 2918 may be directed from an outer ring of the sixth magnetic unit 2918 to an inner ring (as shown by the direction f on a right side of the first magnetic unit 2902 in the figure, the magnetization direction of the first magnetic unit 2902 may deflect 270 degrees in a clockwise direction). In some embodiments, in the same vertical direction, the magnetization direction of the sixth magnetic unit 2918 may be the same as that of the second magnetic unit 2908. In some embodiments, the magnetization direction of the first magnetic unit 2902 may be perpendicular to the lower surface or the upper surface of the first magnetic unit 2902 and be vertically upward (as shown by the direction a in the figure). The magnetization direction of the seventh magnetic unit 2920 may be directed from the lower surface of the seventh magnetic unit 2920 to the upper surface (as shown by the direction e on the right side of the first magnetic unit 2902 in the figure, the magnetization direction of the first magnetic unit 2902 may deflect 360 degrees in the clockwise direction). In some embodiments, a magnetization direction of the seventh magnetic unit 2920 may be the same as that of the fourth magnetic unit 2912.

In some embodiments, at a position of the sixth magnetic unit 2918, an included angle between a direction of a magnetic field generated by the magnetic circuit component 2900 and the magnetization direction of the sixth magnetic unit 2918 may not be higher than 90 degrees. In some embodiments, at the position of the sixth magnetic unit 2918, the included angle between the direction of the magnetic field generated by the first magnetic unit 2902 and the direction of magnetization of the sixth magnetic unit 2918 may be less than or equal to 90 degrees, such as 0 degrees, 10 degrees, or 20 degrees.

In some embodiments, an included angle between the magnetization direction of the first magnetic unit 2902 and the magnetization direction of the seventh magnetic unit 2920 may be between 0 degrees and 180 degrees. In some embodiments, the included angle between the magnetization direction of the first magnetic unit 2902 and the magnetization direction of the seventh magnetic unit 2920 may be between 45 degrees and 135 degrees. In some embodiments, the included angle between the magnetization direction of the first magnetic unit 2902 and the magnetization direction of the seventh magnetic unit 2920 may not be higher than 90 degrees.

In some embodiments, at a position of the seventh magnetic unit 2920, an included angle between a direction of a magnetic field generated by the magnetic circuit component 3000 and the magnetization direction of the seventh magnetic unit 2920 may not be higher than 90 degrees. In some embodiments, at the position of the seventh magnetic unit 2920, the included angle between the direction of the magnetic field generated by the first magnetic unit 2902 and the direction of magnetization of the seventh magnetic unit 2920 may be less than or equal to 90 degrees, such as 0 degrees, 10 degrees, or 20 degrees.

In some embodiments, the first full magnetic field changing unit 2906 may be a ring-shaped magnetic unit. In such cases, a magnetization direction of the first full magnetic field changing unit 2906 may be the same as that of the second magnetic unit 2908 or the fourth magnetic unit 2912. For example, on the right side of the first magnetic unit 2902, the magnetization direction of the first full magnetic field changing unit 2906 may be directed from an outer ring to an inner ring of the first full magnetic field changing unit 2906. In some embodiments, the second ring unit 2922 may be a ring-shaped magnetic unit. In such cases, a magnetization direction of the second ring unit 2922 may be the same as that of the sixth magnetic unit 2918 or the seventh magnetic unit 2920. For example, on the right side of the first magnetic unit 2902, the magnetization direction of the second ring unit 2922 may be directed from an outer ring to an inner ring of the second ring unit 2922.

In the magnetic circuit component 3000, a number of magnetic units may increase the total magnetic flux. Different magnetic units may interact with each other, thereby suppressing the leakage of the magnetic induction lines, increasing the magnetic induction strength in the magnetic gap, and improving the sensitivity of the loudspeaker apparatus.

Figure 21:
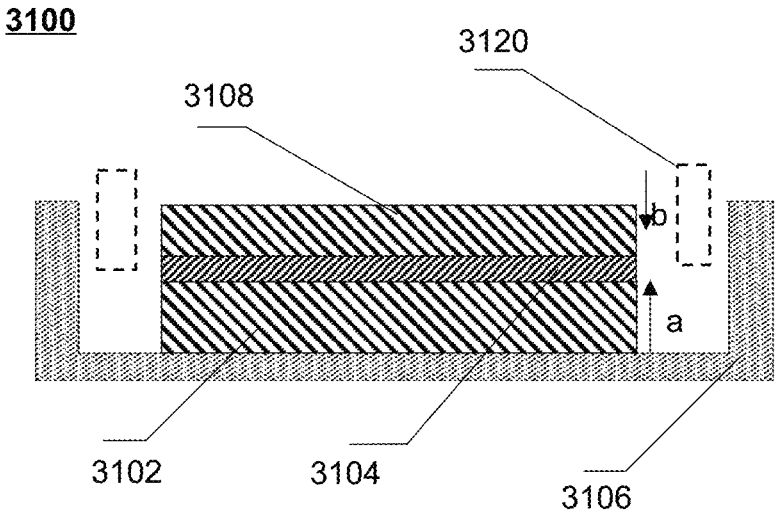
FIG. 21 is a longitudinal sectional schematic diagram illustrating a magnetic circuit component 3100 according to some embodiments of the present disclosure.

FIG. 21 is a longitudinal sectional view illustrating a magnetic circuit component 3100 according to some embodiments of the present disclosure. As shown in FIG. 21, the magnetic circuit component 3100 may include a first magnetic unit 3102, a first magnetically conductive unit 3104, a second magnetically conductive unit 3106, and a second magnetic unit 3108.

In some embodiments, the first magnetic unit 3102 and/or the second magnetic unit 3108 may include any one or more of the magnets described in the present disclosure. In some embodiments, the first magnetic unit 3102 may include a first magnet. The second magnetic unit 3108 may include a second magnet. The first magnet may be the same as or different from the second magnet. The first magnetically conductive unit 3104 and/or the second magnetically conductive unit 3106 may include any one or more magnetically conductive materials described in the present disclosure. The processing manner of the first magnetically conductive unit 3104 and/or the second magnetically conductive unit 3106 may include any one or more processing manners described in the present disclosure. In some embodiments, the first magnetic unit 3102, the first magnetically conductive unit 3104, and/or the second magnetic unit 3108 may be disposed as an axisymmetric structure. For example, the first magnetic unit 3102, the first magnetically conductive unit 3104, and/or the second magnetic unit 3108 may be cylinders. In some embodiments, the first magnetic unit 3102, the first magnetically conductive unit 3104, and/or the second magnetic unit 3108 may be coaxial cylinders with the same diameter or different diameters. The thickness of the first magnetic unit 3102 may be greater than or equal to the thickness of the second magnetic unit 3108. In some embodiments, the second magnetically conductive unit 3106 may be a groove-type structure. The groove-type structure may include a U-shaped section. The groove-type second magnetically conductive unit 3106 may include a bottom plate and a side wall. In some embodiments, the bottom plate and the side wall may be integrally formed as a whole. For example, the side wall may be formed by extending the bottom plate in a direction perpendicular to the bottom plate. In some embodiments, the bottom plate may be connected to the side wall through any one or more connection manners described in the present disclosure. The second magnetic unit 3108 may be disposed as a ring shape or a sheet shape. The shape of the second magnetic unit 3108 may refer to descriptions elsewhere in the specification. In some embodiments, the second magnetic unit 3108 may be coaxial with the first magnetic unit 3102 and/or the first magnetically conductive unit 3104.

An upper surface of the first magnetic unit 3102 may be connected to a lower surface of the first magnetically conductive unit 3104. A lower surface of the first magnetic unit 3102 may be connected to the bottom plate of the second magnetically conductive unit 3106. A lower surface of the second magnetic unit 3108 may be connected to an upper surface of the first magnetically conductive unit 3104. A connection manner between the first magnetic unit 3102, the first magnetically conductive unit 3104, the second magnetically conductive unit 3106 and/or the second magnetic unit 3108 may include one or more manners such as bonding, snapping, welding, riveting, bolting, or the like, or any combination thereof.

A magnetic gap may be formed between the first magnetic unit 3102, the first magnetically conductive unit 3104, and/or the second magnetic unit 3108 and the side wall of the second magnetically conductive unit 3106. A voice coil may be disposed in the magnetic gap. In some embodiments, the first magnetic unit 3102, the first magnetically conductive unit 3104, the second magnetically conductive unit 3106, and the second magnetic unit 3108 may form a magnetic circuit. In some embodiments, the magnetic circuit component 3100 may generate a first full magnetic field. The first magnetic unit 3102 may generate a second magnetic field. The first full magnetic field may be formed by magnetic fields generated by all components (e.g., the first magnetic unit 3102, the first magnetically conductive unit 3104, the second magnetically conductive unit 3106, and the second magnetic unit 3108) in the magnetic circuit component 3100. A magnetic field strength of the first full magnetic field in the magnetic gap (also referred to magnetic induction strength or magnetic flux density) may be greater than a magnetic field strength of the second magnetic field in the magnetic gap. In some embodiments, the second magnetic unit 3108 may generate a third magnetic field. The third magnetic field may increase the magnetic field strength of the second magnetic field in the magnetic gap.

In some embodiments, an included angle between a magnetization direction of the second magnetic unit 3108 and a magnetization direction of the first magnetic unit 3102 may be between 90 degrees and 180 degrees. In some embodiments, the included angle between the magnetization direction of the second magnetic unit 3108 and the magnetization direction of the first magnetic unit 3102 may be between 150 degrees and 180 degrees. In some embodiments, the magnetization direction of the second magnetic unit 3108 may be opposite to that of the first magnetic unit 3102 (the direction a and the direction b shown in the figure).

Compared with a magnetic circuit component with a single magnetic unit, the magnetic circuit component 3100 may add the second magnetic unit 3108. The magnetization direction of the second magnetic unit 3108 may be opposite to the magnetization direction of the first magnetic unit 3102, which may suppress a magnetic leakage of the first magnetic unit 3102 in the magnetization direction. Therefore, the magnetic field generated by the first magnetic unit 3102 may be more compressed into the magnetic gap, thereby increasing the magnetic induction strength within the magnetic gap.

It should be noted that the description of the loudspeaker apparatus described above is merely for illustration purposes and should not be regarded as the only feasible implementation solution. Obviously, for those skilled in the art, after understanding the basic principle of the loudspeaker apparatus, it may be possible to make various modifications and changes in forms and details of the specific methods and operations of implementing the loudspeaker apparatus without departing from the principles, but these modifications and changes are still within the scope described above. For example, the magnetic unit in the magnetic circuit component is not limited to the first magnetic unit, the second magnetic unit, the third magnetic unit, the fourth magnetic unit, the fifth magnetic unit, the sixth magnetic unit, and the seventh magnetic unit. The number of magnetic units may be increased or decreased. Such deformations are all within the protection scope of the present disclosure.

In some embodiments, the loudspeaker apparatus (e.g., MP3 Player) described above may also transmit the sound to the user through air conduction. When the air condition is used to transmit the sound, the loudspeaker apparatus may include one or more sound sources. The sound source may be located at a specific position of the user's head, for example, the top of the head, a forehead, a cheek, a temple, an auricle, the back of an auricle, etc., without blocking or covering an ear canal. FIG. 22 is a schematic diagram illustrating transmitting a sound through air conduction according to some embodiments of the present disclosure.

As shown in FIG. 22, a sound source 2210 and a sound source 2220 may generate sound waves with opposite phases ("+" and "−" in the figure indicate the opposite phases). For brevity, the sound source mentioned herein may refer to sound outlets of the loudspeaker apparatus that may output sounds. For example, the sound source 2210 and the sound source 2220 may be two sound outlets respectively located at specific positions of the eyeglasses (for example, the core housing 20, or the circuit housing 30).

In some embodiments, the sound source 2210 and the sound source 2220 may be generated by the same vibration device 2201. The vibration device 2201 may include a diaphragm (not shown in the figure). When the diaphragm is driven to vibrate by an electric signal, the front side of the diaphragm may drive the air to vibrate, the sound source 2210 may form at the sound outlet through a sound guiding channel 2212, the back of the diaphragm may drive air to vibrate, and the sound source 3320 may form at the sound outlet through a sound guiding channel 3322. The sound guiding channel may refer to a sound transmission route from the diaphragm to the corresponding sound outlet. In some embodiments, the sound guiding channel may be a route surrounded by a specific structure on the loudspeaker apparatus (for example, the earphone housing 220 in FIG. 19, or the eyeglass temple 15 in FIG. 1). It should be known that, in some alternative embodiments, the sound source 3310 and the sound source 3320 may also be generated by different vibrating diaphragms of different vibration devices, respectively.

Among the sounds generated by the sound source 2210 and the sound source 2220, one portion may be transmitted to the ear of the user to form the sound heard by the user. Another portion may be transmitted to the environment to form a leaked sound. Considering that the sound source 2210 and the sound source 2220 are relatively close to the ears of the user, for convenience of description, the sound transmitted to the ears of the user may be referred to as a near-field sound. The leaked sound transmitted to the environment may be referred to as a far-field sound. In some embodiments, the near-field/far-field sounds of different frequencies generated by the loudspeaker apparatus may be related to a distance between the sound source 2210 and the sound source 2220. Generally speaking, the near-field sound generated by the loudspeaker apparatus may increase as the distance between the two sound sources increases, while the generated far-field sound (the leaked sound) may increase with increasing the frequency.

For the sounds of different frequencies, the distance between the sound source 2210 and the sound source 2220 may be designed, respectively, so that a low-frequency near-field sound (e.g., a sound with a frequency of less than 800 Hz) generated by the loudspeaker apparatus may be as large as possible and a high-frequency far-field sound (e.g., a sound with a frequency greater than 2000 Hz) may be as small as possible. In order to implement the above purpose, the loudspeaker apparatus may include two or more sets of dual sound sources. Each set of the dual sound sources may include two sound sources similar to the sound source 2210 and the sound source 2220, and generate sounds with specific frequencies, respectively. Specifically, a first set of the dual sound sources may be used to generate low frequency sounds. A second set of the dual sound sources may be used to generate high frequency sounds. In order to obtain more low-frequency near-field sounds, the distance between two sound sources in the first set of the dual sound sources may be set to a larger value. Since the low-frequency signal has a longer wavelength, the larger distance between the two sound sources may not cause a large phase difference in the far-field, and not form excessive leaked sound in the far-field. In order to make the high-frequency far-field sound smaller, the distance between the two sound sources in the second set of the dual sound sources may be set to a smaller value. Since the high-frequency signal has a shorter wavelength, the smaller distance between the two sound sources may avoid the generation of the large phase difference in the far-field, and thus the generation of the excessive leaked sounds may be avoided. The distance between the second set of the dual sound sources may be less than the distance between the first set of the dual sound sources.

The beneficial effects of the embodiments of the present disclosure may include but be not limited to: (1) the protective sleeve of the ear hook may elastically abut against the core housing, thereby improving the waterproof performance of the loudspeaker apparatus; (2) the size of the forming mold may be reduced by using different molds to form the ear hook and the core housing separately, thereby reducing the difficulty of mold processing and forming the ear hook and the core housing during production; (3) the sound quality of the loudspeaker may be improved by adjusting the angle between the normal line A of the panel or the normal line A' of the contact surface contacting human skin of the panel and the line B of the driving force generated by the driving device; (4) the sensitivity of the loudspeaker apparatus may be improved by adding a magnetic unit, a magnetically conductive unit and an electrically conductive unit in the magnetic circuit components; (5) the ear hook may use elastic metal wire with a certain elastic deformation, thereby being adapted to users with different ear shapes and head shapes. It should be noted that different embodiments may have different beneficial effects. In different embodiments, the possible beneficial effects may be any one or a combination of the above, and may be any other beneficial effects that may be obtained.

The basic concepts have been described above. Obviously, for persons having ordinary skills in the art, the disclosure of the invention is merely by way of example, and does not constitute a limitation on the present disclosure. Although not explicitly stated here, those skilled in the art may make various modifications, improvements, and amendments to the present disclosure. These alterations, improvements, and modifications are intended to be suggested by this disclosure and are within the spirit and scope of the exemplary embodiments of this disclosure.

What is claimed is:

1. A loudspeaker apparatus, comprising:

an ear hook including a first plug end and a second plug end, the ear hook being surrounded by a protective sleeve, the protective sleeve being made of an elastic waterproof material;

a core housing for accommodating an earphone core, the core housing being fixed to the first plug end and elastically abutted against the protective sleeve; and a circuit housing for accommodating a control circuit or a battery, the circuit housing being fixed to the second plug end, the control circuit or the battery driving the earphone core to vibrate, the vibration of the earphone core generating a driving force to drive a housing panel of the core housing to vibrate, the driving force being not parallel to a normal line of the housing panel.

2. The loudspeaker apparatus of claim 1, wherein the ear hook further includes:

an elastic metal wire;

a wire; and a fixed sleeve, the fixed sleeve fixing the wire on the elastic metal wire, the protective sleeve being formed, by injection molding, on periphery of the elastic metal wire, the wire, the fixed sleeve, the first plug end, and the second plug end.

3. The loudspeaker apparatus of claim 2, wherein the first plug end and the second plug end are formed, by injection molding, at both ends of the elastic metal wire respectively, the first plug end and the second plug end are arranged with a first wiring channel and a second wiring channel respectively, and the wire extends along the first wiring channel and the second wiring channel.

4. The loudspeaker apparatus of claim 3, wherein the wire passes through the first wiring channel and the second wiring channel.

5. The loudspeaker apparatus of claim 3, wherein the first wiring channel includes a first wiring groove and a first wiring hole connecting the first wiring groove and an outer end surface of the first plug end, the wire extends along the first wiring groove and the first wiring hole and is exposed on the outer end surface of the first plug end, the second wiring channel includes a second wiring groove and a second wiring hole connecting the second wiring groove and the outer end surface of the first plug end, and the wire extends along the second wiring groove and the second wiring hole and is exposed on the outer end surface of the second plug end.

6. The loudspeaker apparatus of claim 2, wherein the ear hook includes at least two fixed sleeves spaced apart along the elastic metal wire.

7. The loudspeaker apparatus of claim 1, wherein the core housing is arranged with a first socket connecting with an outer end surface of the core housing, a stopping block is arranged on an inner sidewall of the first socket, and the first socket is connected to the first plug end.

8. The loudspeaker apparatus of claim 7, wherein the first plug end includes:

an inserting portion being at least partially inserted into the first socket and abutting against an outer side surface of the stopping block; and two elastic hooks being arranged on a side of the inserting portion facing inside of the core housing, wherein:

the two elastic hooks are brought together under action of external thrust and the stopping block, and after passing through the stopping block, the two elastic hooks are elastically restored to be stuck on an inner surface of the stopping block to realize the fixation of the core housing and the first plug end.

9. The loudspeaker apparatus of claim 8, wherein the inserting portion is partially inserted into the first socket, and an exposed part of the inserting portion is arranged in a stepped manner to form an annular table surface spaced apart from the outer end surface of the core housing.

10. The loudspeaker apparatus of claim 9, wherein the protective sleeve further extends to a side of the annular table surface facing the outer end surface of the core housing, and when the core housing and the first plug end are fixed, the protective sleeve elastically abuts against the core housing to realize sealing.

11. The loudspeaker apparatus of claim 1, wherein the ear hook further includes a housing sheath integrally formed with the protective sleeve, the housing sheath being wrapped around periphery of the circuit housing.

12. The loudspeaker apparatus of claim 1, wherein the housing panel and the earphone core are in a transmission connection, and all or part of the housing panel is used to contact or abut a user's body to conduct a sound generated by the vibration of the earphone core.

13. The loudspeaker apparatus of claim 12, wherein when a straight line of the driving force has a positive direction pointing to outside of the loudspeaker apparatus from the housing panel and the normal line has a positive direction pointing to the outside of the loudspeaker apparatus, an angle between the two lines in their positive direction is an acute angle.

14. The loudspeaker apparatus of claim 12, wherein the earphone core includes a coil and a magnetic circuit system, and an axis of the coil or the magnetic circuit system is not parallel to the normal line, the axis being perpendicular to a radial plane of the coil or the magnetic circuit system.

15. The loudspeaker apparatus of claim 12, wherein the driving force has a component in a first quadrant or a third quadrant of an XOY plane coordinate system, wherein an origin O of the XOY plane coordinate system is on a contact surface between the loudspeaker apparatus and a human body, an X-axis of the XOY plane coordinate system is parallel to a coronal axis of the human body, a Y-axis of the XOY plane coordinate system is parallel to a sagittal axis of the human body, a positive direction of the X-axis faces outside of the human body, and a positive direction of the Y-axis faces front of the human body.

16. The loudspeaker apparatus of claim 1, wherein the earphone core further includes a magnetic circuit component generating a first magnetic field, the magnetic circuit component including:

a first magnetic unit configured to generate a second magnetic field;

a first magnetically conductive unit; and at least one second magnetic unit, the at least one second magnetic unit surrounding the first magnetic unit and forming a magnetic gap with the first magnetic unit, a magnetic field strength of the first magnetic field in the magnetic gap being greater than a magnetic field strength of the second magnetic field in the magnetic gap.

17. The loudspeaker apparatus of claim 16, wherein the magnetic circuit component further includes:

a second magnetically conductive unit; and at least one third magnetic unit being connected to the second magnetically conductive unit and the at least one second magnetic unit.

18. The loudspeaker apparatus of claim 17, wherein the magnetic circuit component further includes:

at least one fourth magnetic unit being located below the magnetic gap and connected to the first magnetic unit and the second magnetically conductive unit.

19. The loudspeaker apparatus of claim 17, wherein the first magnetically conductive unit is connected to the upper surface of the first magnetic unit, the second magnetically conductive unit includes a bottom plate and a sidewall; and the first magnetic unit is connected to the bottom plate of the second magnetically conductive unit.

20. The loudspeaker apparatus of claim 17, further comprising:

at least one electrically conductive unit being connected to at least one unit of the first magnetic unit, the first magnetically conductive unit, or the second magnetically conductive unit.

* * * * *